US008581128B2

(12) United States Patent
Ito et al.

(10) Patent No.: US 8,581,128 B2
(45) Date of Patent: Nov. 12, 2013

(54) BREAKER

(75) Inventors: Masahiro Ito, Ise (JP); Katumi Yositani, Watarai-gun (JP); Katsuya Uruma, Watarai-gun (JP)

(73) Assignee: Panasonic Corporation, Osaka (JP)

( * ) Notice: Subject to any disclaimer, the term of this patent is extended or adjusted under 35 U.S.C. 154(b) by 392 days.

(21) Appl. No.: 12/953,548

(22) Filed: Nov. 24, 2010

(65) Prior Publication Data

US 2011/0120846 A1 May 26, 2011

(30) Foreign Application Priority Data

Nov. 24, 2009 (JP) ..... 2009-266580
Jun. 28, 2010 (JP) ..... 2010-146709

(51) Int. Cl.
*H01H 3/20* (2006.01)
*H01H 17/00* (2006.01)

(52) U.S. Cl.
USPC ..... 200/331; 200/302.3

(58) Field of Classification Search
USPC ..... 200/331, 335, 553, 302.3, 332, 557, 200/302.1
See application file for complete search history.

(56) References Cited

U.S. PATENT DOCUMENTS 1,924,351 A 8/1933 Doddridge
2,718,575 A * 9/1955 Taylor ..... 200/302.3
4,129,761 A * 12/1978 Okutomi et al. ..... 218/132
5,140,115 A * 8/1992 Morris ..... 200/308
6,204,460 B1 * 3/2001 Hojo et al. ..... 200/302.2
2007/0063808 A1 3/2007 Darr et al.

FOREIGN PATENT DOCUMENTS

| | | |
|---|---|---|
| DE | 297 14 134 | 10/1997 |
| EP | 1739701 | 1/2007 |
| JP | H07-014456 | 1/1995 |
| JP | 11339605 | 12/1999 |
| JP | 2007012362 | 1/2007 |

OTHER PUBLICATIONS

The extended European search report dated Aug. 3, 2012.
The Korean Office Action dated Oct. 19, 2011 and English summary thereof.

* cited by examiner

*Primary Examiner* — Renee Luebke
*Assistant Examiner* — Lheiren Mae Caroc
(74) *Attorney, Agent, or Firm* — Bacon & Thomas, PLLC

(57) ABSTRACT

A breaker includes a contact unit provided in an airtight container. The contact unit has fixed contact points and a movable contact point which selectively contacts with the fixed contact points. Further, the breaker include a movable shaft having a part projecting outward from the airtight container, for moving the movable contact point to and from the fixed contact points, and a metal member for ensuring airtightness of the airtight container. The metal member has one end fixed to the airtight container and the other end fixed to the movable shaft and is extensible and contractible in accordance with the movement of the movable shaft. Moreover, the breaker includes a lever unit for moving the movable shaft between a closed position where the movable contact point is in contact with the fixed contact points and an open position where the movable contact point is separated from the fixed contact points.

12 Claims, 31 Drawing Sheets

BREAKER

FIELD OF THE INVENTION

The present invention relates to a breaker used in a DC high voltage circuit.

BACKGROUND OF THE INVENTION

Conventionally, there has been used a DC circuit breaker which is installed in an electric circuit to allow or prevent supply of a DC power to a load (see, e.g., Japanese Patent Application Publication No. H11-339605 (paragraphs [0016] to [0034], and FIGS. 1 to 4)). This DC circuit breaker includes a pair of fixed contactors respectively having fixed contact points and a pair of movable contactors respective having movable contact points which selectively contact with the fixed contact points of the fixed contactors. The contact points of both contactors can be brought into contact with or separated from each other by operating a handle provided at a front surface of a base.

In the DC circuit breaker described in Japanese Patent Application Publication No. H11-339605, a contact unit including the fixed contactors and the movable contactors does not have a sealed structure. Therefore, the contact points may be oxidized or sulfided by gas in the atmosphere, or contact reliability between the contact points may decrease due to adhesion of foreign materials to the contact points. Accordingly, a location where it can be used is limited.

Further, in a circuit which requires a higher DC voltage, arc occurring between contact points increases. Thus, the number of arc-extinguishing grits for extinguishing the arc needs to be increased, and a space therefor is needed. As a consequence, the breaker may be scaled up.

Moreover, the arc occurring between the contact points may be discharged to the outside of the main body by magnetic force. In that case, however, a space for discharging the arc is required, so that other components cannot be installed close to the breaker.

SUMMARY OF THE INVENTION

In view of the above, the present invention provides a small-sized breaker having improved contact reliability between contact points.

In accordance with an aspect of the present invention, there is provided a breaker including: a contact unit provided in an airtight container, the contact unit having fixed contact points and a movable contact point which selectively contacts with the fixed contact points; a movable shaft having a part projecting outward from the airtight container, for moving the movable contact point to and from the fixed contact points; a metal member having one end fixed to the airtight container and the other end fixed to the movable shaft and being extensible and contractible in accordance with the movement of the movable shaft; and a lever unit for moving the movable shaft between a closed position where the movable contact point is in contact with the fixed contact points and an open position where the movable contact point is separated from the fixed contact points.

The lever unit may be connected to the movable shaft.

The breaker may further include a base for accommodating therein at least the contact unit, the movable shaft and the metal member. In this case, the lever unit may include: an inner lever disposed in the base and connected to the movable shaft; a manipulation portion projecting outward from the base; and an outer lever having a pressing portion for pressing the inner lever in accordance with the manipulation of the manipulation portion, the pressing portion of the outer lever and the inner lever being not connected to each other. Further, when the inner lever moves from a position where the contact unit is in a closed state and passes beyond a predetermined position, a biasing unit biases the inner lever to a position where the contact unit reaches an open state, and a space where the inner lever moves is formed between the outer lever and the inner lever.

The lever unit may include: an inner lever connected to the movable shaft, the inner lever being disposed inside a base for accommodating therein at least the contact unit, the movable shaft and the metal member; a manipulation portion projecting outward from the base; and an outer lever having a pressing unit for pressing the inner lever in accordance with the manipulation of the manipulation portion. Further, the breaker may further include: a restricting unit which moves in accordance with a locking operation between a restriction position where the restricting unit is contacted with the pressing unit of the outer lever to restrict the movement of the outer lever and a release position where the restricting unit is separated from the outer lever to release the restriction of the movement of the outer lever; a first biasing spring for applying elastic force for moving the restricting portion toward the restriction position; a latch unit for maintaining the restricting unit in the release position; and a second biasing spring for applying elastic force of a predetermined direction to the outer lever. Moreover, a recess may be formed at the outer lever so as to provide a gap between the outer lever and the restricting unit when the restricting unit is in the release position.

Alternatively, the breaker may further include: a restricting unit which moves in accordance with a locking operation between a restriction position where the restricting unit is contacted with the pressing unit of the outer lever to restrict the movement of the outer lever and a release position where the restricting unit is separated from the outer lever to release the restriction of the movement of the outer lever.

The breaker may further include a latch unit for maintaining the restricting unit in the release position, wherein the lever unit has a releasing portion for releasing the latch of the latch unit.

The breaker may further include a display unit for displaying the state of the contact unit in accordance with the manipulation of the lever unit.

The breaker may further include a third biasing spring for pressing the outer lever to the inner lever.

The breaker may further include an auxiliary contact unit whose contact points are opened and closed in accordance with the movement of the movable shaft.

A predetermined gas having a pressure higher than about 1 atm may be sealed in the airtight container.

The gas may contain at least one of hydrogen, nitrogen and carbon dioxide.

The breaker may further include a restoring spring for restoring the movable shaft to the open position.

The fixed contact points and the movable contact point may be made of copper or copper alloy.

The lever unit may be formed as a single rod-shaped member having one end portion connected to the movable shaft and an intermediate portion serving as a fulcrum. When the other end portion of the rod-shaped member is manipulated to rotate about the fulcrum, the movable shaft is moved between the closed position and the open position in accordance with the manipulation.

The lever unit may include a first member having one end portion connected to the movable shaft, and a second member having one end portion connected to the other end portion of the first member and an intermediate portion serving as a fulcrum. When the other end portion of the second member is manipulated to rotate about the fulcrum of the second member, the movable shaft is moved between the closed position and the open position in accordance with the manipulation.

The present invention can provide a small-sized breaker having improved contact reliability between contact points.

BRIEF DESCRIPTION OF THE DRAWINGS

The objects and features of the present invention will become apparent from the following description of embodiments, given in conjunction with the accompanying drawings, in which:

FIGS. 1A to 1C show a breaker in accordance with a first embodiment of the present invention, wherein FIG. 1A is a schematic cross sectional view of the breaker in an open state; FIG. 1B is a schematic cross sectional view describing a contact state of a contact unit; and FIG. 1C is a schematic cross sectional view of the breaker in a closed state;

FIGS. 4A and 4B show a breaker in accordance with a second embodiment of the present invention, wherein FIG. 4A is a schematic cross sectional view of the breaker in a closed state; and FIG. 4B is a schematic cross sectional view of the breaker in an open state;

FIGS. 6A and 6B show a breaker in accordance with a third embodiment of the present invention, wherein FIG. 6A is a schematic cross sectional view of the breaker in an open state; and FIG. 6B is a schematic cross sectional view of the breaker in a closed state;

DETAILED DESCRIPTION OF THE EMBODIMENT

Figure 1A:
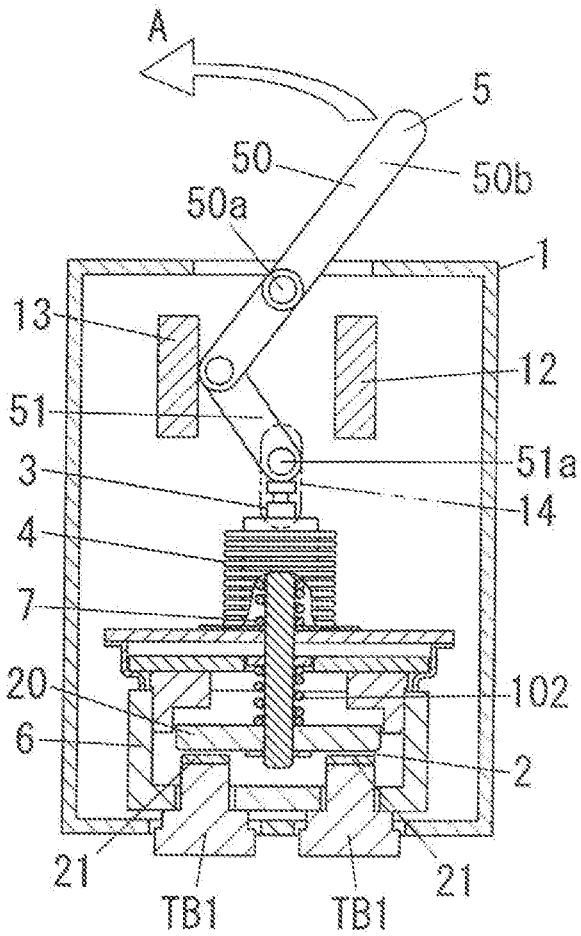

The embodiments of the breaker in accordance with the present invention will be described with reference to the accompanying drawings which form a part hereof. The breaker of the present invention is a nonautomatic breaker in which a contact unit accommodated in a base can be opened and closed by operating a lever provided at a front surface of the base. The breaker of the present invention is used for a circuit having a high voltage battery or the like, for example.

First Embodiment

FIG. 1 shows a schematic view of a breaker in accordance with a first embodiment of the present invention. This breaker includes: a contact unit 2 disposed in an airtight container 6; a movable shaft 3 having a part projecting outward from the airtight container 6; a metal bellows (metal member) 4 for ensuring airtightness of the airtight container 6; a lever unit 5 for moving the movable shaft 3 reciprocally in a vertical direction; and a base 1 which is made of synthetic resin and accommodates therein the above-described components.

Figure 2:
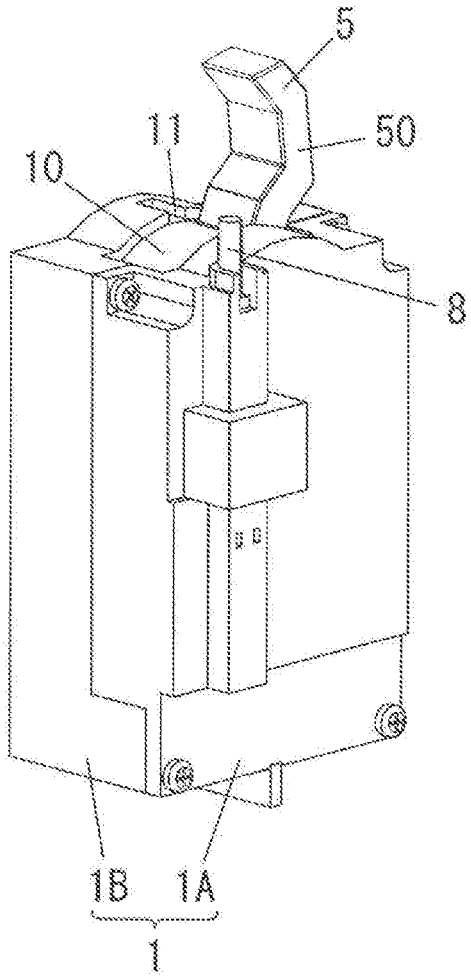
FIG. 2 provides an exterior perspective view of the breaker of the first embodiment.

As illustrated in FIG. 2, the base 1 includes rectangular box-shaped base pieces 1A and 1B each having one open surface. The base 1 is formed by assembling both base pieces 1A and 1B in a state where the opening sides thereof face each other. Further, an opening window 10 where a lever 50 of the lever unit 5 is movably provided is installed at a front surface (top in FIG. 2) of the base 1, and a display window (display unit) 11 extends from the opening window 10. The display window 11 displays the state of the contact unit 2 in accordance with the operation of the lever 50, and whether the contact unit 2 is in an open state or in a closed state can be recognized from the display state of the display window 11 (e.g., "OFF" in the open state, "ON" in the closed state, or the like). In addition, reference numeral "8" in FIG. 2 denotes a locking body to be described later.

As shown in FIG. 1A, the contact unit 2 includes: fixed contact points 21 respectively provided at leading end portions of a pair of fixed terminals TB1; and a movable contact point 20 which selectively contacts with the fixed contact points 21 so as to electrically connect the fixed contact points 21. As described above, the contact unit 2 is hermitically accommodated in the airtight container 6. In this embodiment, the fixed contact points 21 and the movable contact point 20 are made of copper. Besides, the fixed terminals TB1 may be made of copper or other metal materials.

As can be seen from FIG. 1A, the movable shaft 3 is formed as a vertically elongated rod, and has a leading end portion (bottom side in FIG. 1A) attached to the movable contact point 20 and a trailing end portion (top side in FIG. 1A) to which a link 51 of the lever unit 5 is rotatably connected. The movable shaft 3 can move vertically between a closed position in which the movable contact point 20 is in contact with the fixed contact points 21 (as shown in FIG. 1C) and an open position in which the movable contact point 20 is separated from the fixed contact points 21 (as shown in FIG. 1A). Further, in this embodiment, a restoring spring 7 is attached to the trailing end portion of the movable shaft 3, and the movable shaft 3 can be restored to the open position by the spring force of the restoring spring 7. Provided at the leading end portion of the movable shaft 3 is a contact pressure spring 102 for biasing the movable contact point 20 attached to the leading end portion toward the fixed contact points 21. When the movable contact point 20 is in contact with the fixed contact points 21, the contact points 20 and 21 are strongly adhered to each other by the contact pressure spring 102.

As depicted in FIG. 1A, the metal bellows 4 is formed in a shape of a bellows having one vertical end (bottom side in FIG. 1A) fixed around a portion of the airtight container where the movable shaft 3 projects from the airtight container 6 and the other end (top side in FIG. 1A) fixed around a projected portion of the movable shaft 3 (which is exposed outward from the airtight container 6). Hence, the airtightness of the airtight container 6 can be ensured despite the free movement of the movable shaft 3 with respect to the airtight container 6. In other words, the metal bellows 4 is vertically extensible and contractible in accordance with the movement of the movable shaft 3.

The lever unit 5 includes: a lever (second member) 50 having a manipulation portion that projects from the base 1; and the link (first member) 51 having a trailing end portion rotatably connected to the leading end portion of the lever 50 and a leading end portion rotatably connected to the movable shaft 3. Further, a shaft 50*a* provided in the middle of the lever 50 is supported by a shaft supporting portion (not shown) installed at the base 1 and can be rotatably adhered to the base 1. Furthermore, in this embodiment, a shaft 51*a* provided at the leading end portion of the link 51 moves vertically inside a guide groove 14 formed at the base 1, so that the movable shaft 3 can move in an approximately vertical direction.

In this embodiment, a gas mainly containing hydrogen is sealed in the airtight container 6, and a gas pressure of the gas is set to be higher than about 1 atm. As a result, even if the restoring spring 7 is not provided, the movable shaft 3 can be pressed outward (top side in FIG. 1A) by the force of the gas pressure, which enables the movable shaft 3 to move toward an open direction. Moreover, in this embodiment, the gas pressure of the gas may be lower than 1 atm due to the presence of the restoring spring 7. When the gas pressure of the gas is set to be higher than 1 atm, the restoring spring 7 may be omitted.

Hereinafter, the operation of the breaker will be described with reference to FIGS. 1A to 1C. FIG. 1A shows an open state of the contact unit 2 (in which the movable contact point 20 is separated from the fixed contact points 21). When the manipulation portion 50*b* of the lever 50 is made to rotate from the open state in a counterclockwise direction (indicated by the arrow A in FIG. 1A), the connecting portion between the lever 50 and link 51 moves rightward. At this time, the movable shaft 3 is pressed downward, so that the movable contact point 20 is brought into contact with the fixed contact points 21 (see FIG. 1B).

Figure 1B:
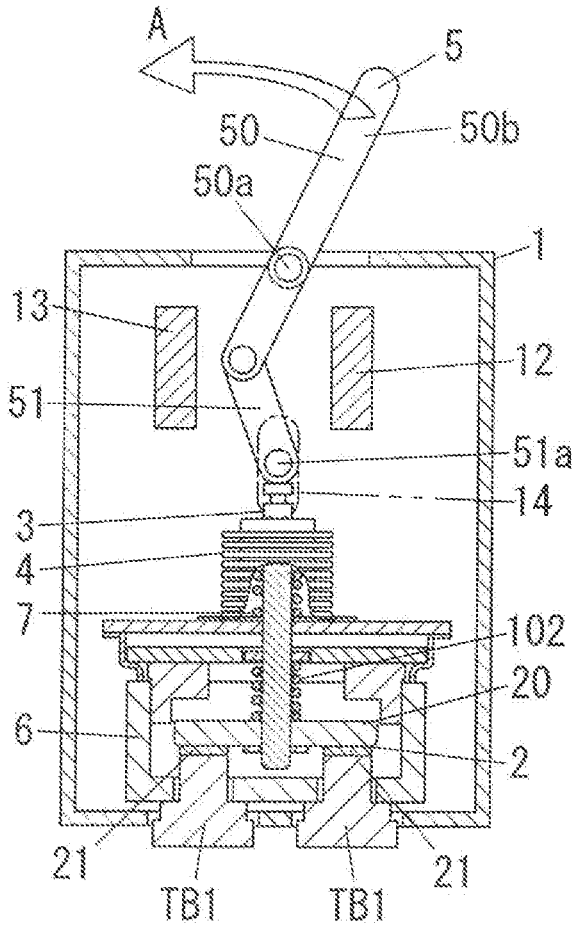
Figure 1C:
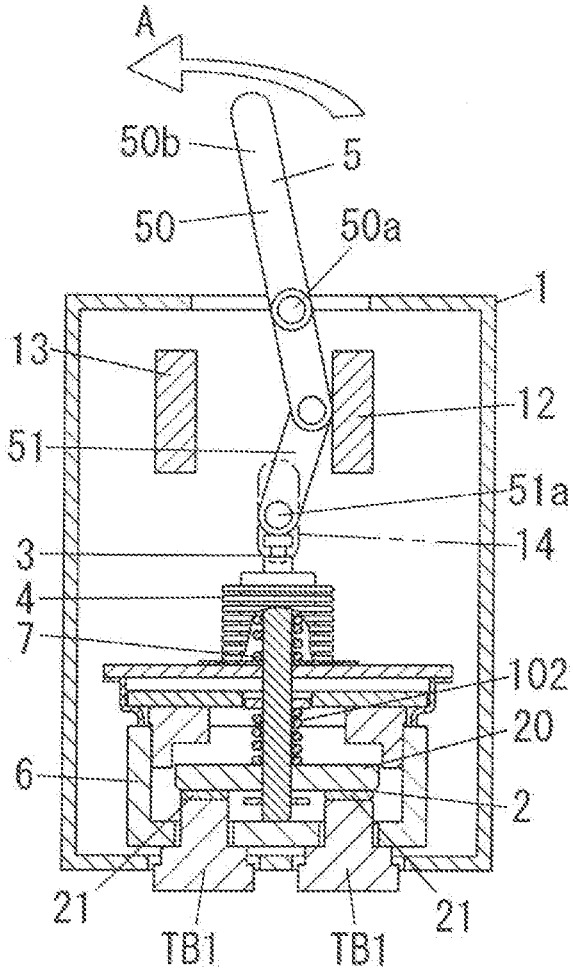

When the lever 50 is made to rotate further from the state shown in FIG. 1B in the counterclockwise direction, the movable shaft 3 is further pressed downward against the spring force of the restoring spring 7. When the connecting portion passes beyond a segment which connects the shaft 50*a* of the lever 50 and the shaft 51*a* of the link 51, the connecting portion quickly moves rightward by the spring force of the restoring spring 7. As a result, the closed state shown in FIG. 1C (in which the movable contact point is in contact with the fixed contact points 21) is obtained. At this time, the connecting portion comes into contact with a stopper 12 provided at the base 1, and this state is maintained by the spring force of the restoring spring 7. Besides, the movable contact point 20 is strongly adhered to the fixed contact points 21 by the spring force of the contact pressure spring 102.

Further, when the manipulation portion 50*b* of the lever 50 is made to rotate from the closed state shown in FIG. 1C in a clockwise direction (opposite to the arrow A in FIG. 1C), the contact unit 2 reaches the open state via the state shown in FIG. 1B. In that case as well, when the connecting portion between the lever 50 and the link 51 passes beyond the segment which connects the shaft 50*a* of the lever 50 and the shaft 51*a* of the link 51, the connecting portion is rapidly moved leftward by the spring force of the restoring spring 7. As a result, the open state of FIG. 1A is obtained. At this time, the connecting portion is brought into contact with a stopper 13 provided at the base 1, and this state is maintained by the spring force of the restoring spring 7. In other words, in this embodiment, the lever 50 and the link 51 move between the stoppers 12 and 13 in a horizontal direction.

In the breaker shown in FIGS. 1A to 1C, the lever unit 5 includes two members, i.e., the lever 50 and the link 51, and can be manipulated with little power by using a lever rule in which the shaft 50*a* of the lever 50 is used as a fulcrum. Moreover, since the lever unit 5 is formed by the two members, friction caused when the contact unit 2 is made to be in the closed state can be reduced and the opening speed of the contact unit 2 can be increased. Accordingly, the arc can be quickly extinguished, and this can prolong the contact point life.

Figure 3A:
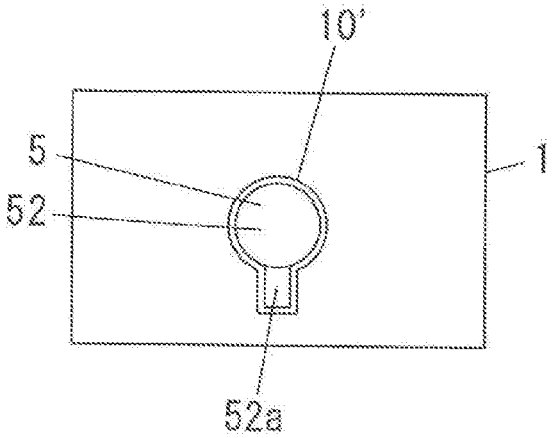
FIG. 3A is a schematic cross sectional view of a modification of the breaker of the first embodiment.
Figure 3B:
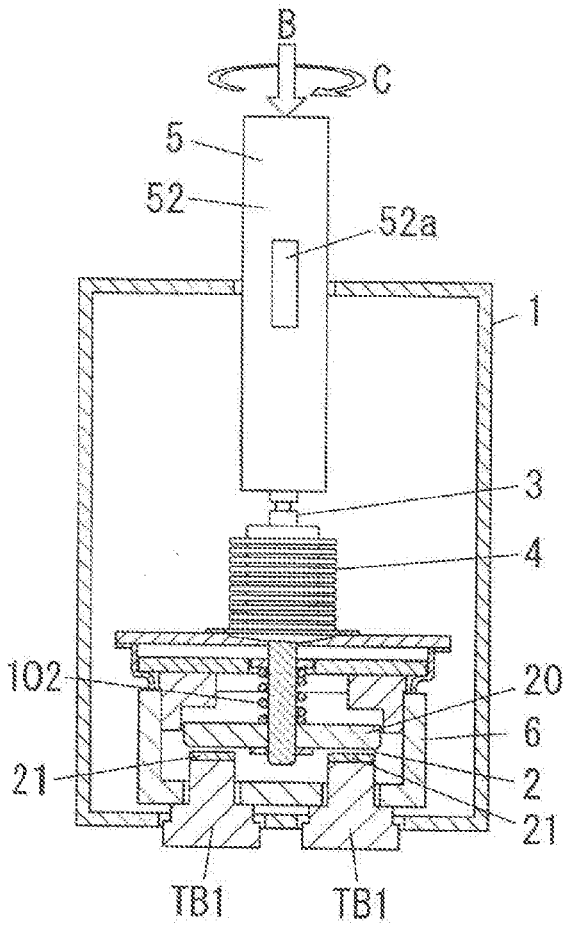
FIG. 3B illustrates a top view thereof.
Figure 3C:
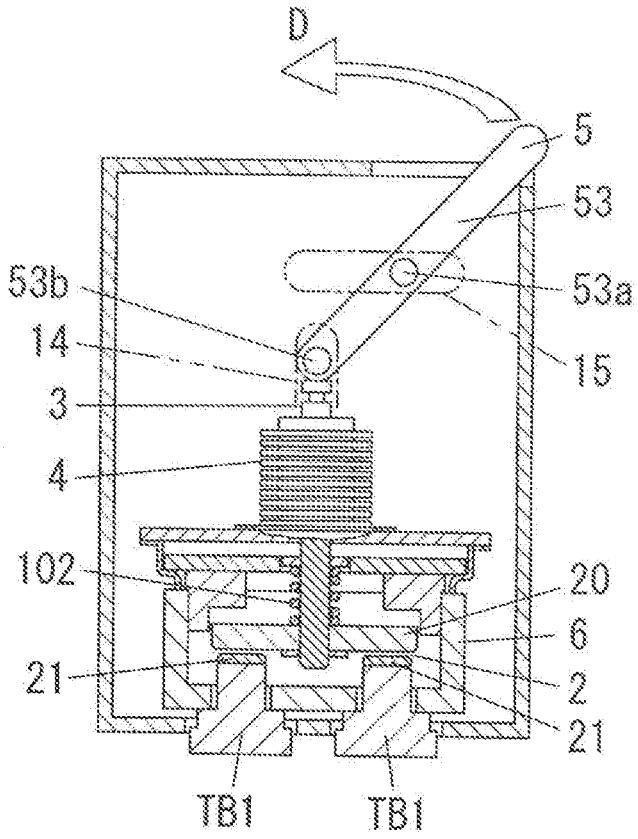
FIG. 3C is a schematic cross sectional view of another modification of the breaker of the first embodiment.

FIGS. 3A to 3C depict a modification of the breaker of the present embodiment. In FIGS. 3A and 3B, a direct acting rotation lever 52 is used as the lever unit 5. In FIG. 3C, a lever 53 formed as a single rod-shaped member serves as the lever unit 5. Other configurations are the same as those of the breaker illustrated in FIGS. 1A to 1C. Therefore, like reference numerals will be given to like parts, and redundant description thereof will be omitted.

In the breaker of FIGS. 3A and 3B, the lever 52 can move vertically through a through hole 10' (see FIG. 3B) formed at the front surface of the base 1. Further, the closed state of the contact unit 2 can be maintained by fixedly engaging an engagement projection 52*a* formed at a side surface of the lever 52 to an inner opening edge of the through hole 10'. In other words, the lever 52 is pressed downward (in the direction indicated by the arrow B in FIG. 3A) until the engagement projection 52*a* in the state shown in FIG. 3A is inserted into the base 1. Next, when the lever 52 is made to rotate in the direction indicated by the arrow C in FIG. 3A in a state where the engagement projection 52*a* is inserted into the base 1, the engagement projection 52*a* is fixedly engaged to the inner opening edge of the through hole 10'. At this time, the movable shaft 3 is pressed downward by the lever 52, so that the contact unit 2 reaches the closed state.

Further, when the positions of the engagement projection 52*a* of the lever 52 and the through hole 10' are aligned by rotating the lever 52 from the closed state in a direction opposite to the arrow C in FIG. 3A, the lever 52 is pressed upward by spring force of a restoring spring (not shown). As a result, the open state shown in FIG. 3A is obtained.

In the breaker of FIG. 3C, the base 1 is provided with a guide groove 14 for vertically guiding a shaft 53*b* provided at a leading end portion of the lever 53 and a guide groove 15 for horizontally guiding a shaft 53*a* formed at an intermediate portion of the lever 53. Moreover, when the lever 53 is made to rotate in the counterclockwise direction (in the direction indicated by the arrow D in FIG. 3C), the shaft 53*a* moves leftward along the guide groove 15 and, also, the shaft 53*b* moves downward along the guide groove 14. As a result, the movable shaft 3 is pressed downward against spring force of a restoring spring (not shown), and the movable contact point 20 is brought into contact with the fixed contact points 21 and reaches the closed state. In the closed state, the lever 53 can be held by a holding unit (not shown).

Furthermore, when the lever 53 is made to rotate from the closed state in the clockwise direction (in the direction opposite to the arrow D in FIG. 3C), the shaft 53*a* moves rightward along the guide groove 15 and, also, the shaft 53*b* moves upward along the guide groove 14. As a consequence, the movable shaft 3 is pressed upward by the spring force of the restoring spring, and the movable contact point 20 is separated from the fixed contact points 21 and reaches the open state. Here, the breaker of FIG. 3C can be manipulated with little power by using the lever rule in which the shaft 53*a* is used as a fulcrum.

In accordance with this embodiment, the contact unit 2 including the fixed contact points 21 and the movable contact point 20 is disposed in the airtight container 6, so that it is possible to prevent the contact points 20 and 21 from being oxidized or sulfided by impure gas in an atmosphere of a location where the breaker is used, and also possible to avoid adhesion of foreign materials to the contact points 20 and 21. As a result, the contact reliability between the contact points 20 and 21 can be improved. In addition, leakage of the arc to the outside can be avoided by providing the contact unit 2 inside the airtight container 6. Hence, even in case of using a circuit which requires a high DC voltage, it is unnecessary to increase the number of arc-extinguishing grits for extinguishing the arc unlike in the conventional example. Accordingly, the breaker can be scaled down, and other components can be disposed close to the breaker.

Further, the lever unit 5 is connected to the movable shaft 3, and the position of the movable shaft 3 can be recognized by the position of the lever unit 5. Thus, the operation state of the breaker can be recognized. In this embodiment, the operation state of the breaker can be more accurately recognized due to the presence of the display window 11. Moreover, in this embodiment, a gas mainly containing hydrogen is sealed in the airtight container 6, so that the contact points 20 and 21 can be reduced by arc heat. Accordingly, the contact reliability between the contact points 20 and 21 can be further improved, and high-voltage blocking performance can be improved. In addition, since the contact unit 2 is disposed inside the airtight container 6, copper that is easily oxidized can be used. As a result, costs can be reduced compared to a case of using silver contact points.

Although the gas mainly containing hydrogen is described as an example in this embodiment, a gas mainly containing any one of nitrogen or carbon dioxide, or a gas containing at least two selected from hydrogen, nitrogen and carbon dioxide may be used. In addition, the configuration of the contact unit 2 of this embodiment is only an example and is not limited to that described in this embodiment. Besides, although the movable contact point 20 and the fixed contact points 21 are made of copper in this embodiment, they may be made of copper alloy. In that case, costs can be reduced compared to the case of using silver contact points.

Second Embodiment

A breaker in accordance with a second embodiment of the present invention will be described with reference to FIGS. 4A to 5B. In this embodiment, a lever unit 5 includes: an outer lever 52 having a manipulation portion 52*a* manipulated by an operator; and an inner lever (a lever 50 and a link 51) for vertically moving a movable shaft 3 in accordance with the manipulation of the outer lever 52. This embodiment is characterized in that a pressing unit (projection portions 52*b* and 52*c*) of the outer lever 52 and the lever 50 are not connected to each other. Other configurations are the same as those of the first embodiment. Therefore, like reference numerals will be given to like parts, and redundant description thereof will be omitted.

Figure 4A:
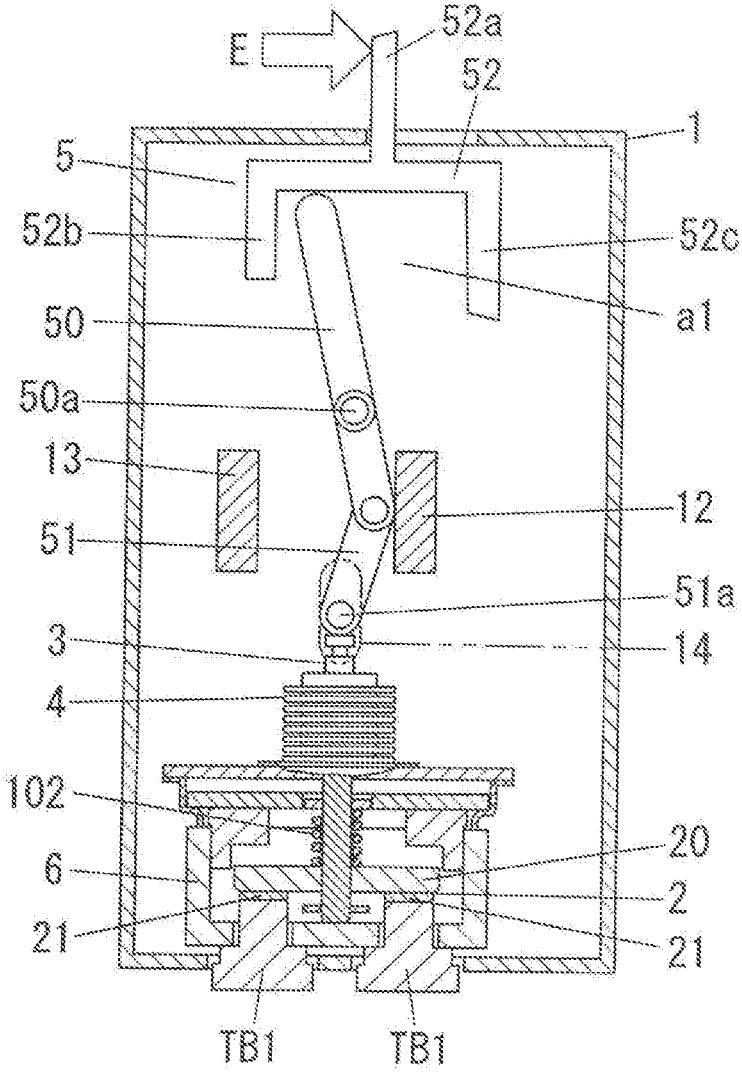

As shown in FIG. 4A, the breaker of this embodiment includes a base 1, a contact unit 2, the movable shaft 3, a metal bellows 4, and the lever unit 5.

As can be seen from FIG. 4A, the lever unit 5 includes: the outer lever 52 having at both end portions thereof the projection portions 52*b* and 52*c* that project downward and having a substantially reverse U-shaped cross section; and the inner lever having two members, i.e., the lever 50 and the link 51. Further, the projection portions 52*b* and 52*c* of the outer lever 52 and the lever 50 have a non-connection structure. In other words, in this embodiment, the outer lever 52 and the inner lever are not connected to each other. Moreover, the manipulation portion 52*a* projecting outward from the front surface (top side in FIG. 4A) of the base 1 is formed as a unit with the outer lever 52 and can move freely in the horizontal direction. Moreover, the inner lever is rotatably supported at the base 1 by a shaft 50*a* provided at an intermediate portion of the lever 50, and the movable shaft 3 is rotatably connected to a leading end portion of the link 51 rotatably connected to a front end portion (bottom side in FIG. 4A) of the lever 50 and can move in a vertical direction in accordance with the movement of the inner lever. In this embodiment as well, a shaft 51*a* is provided at the leading end portion of the link 51, and can move in the vertical direction along the guide groove 14 formed at the base 1.

Hereinafter, the operation of the breaker will be described with reference to FIGS. 4A and 4B. FIG. 4A depicts a closed state of the contact unit 2. When the manipulation portion 52*a* of the outer lever 52 in the closed state is pressed rightward (in the direction indicated by the arrow E in FIG. 4A), the lever 50 rotates in the clockwise direction while being pressed by the projection portion 52*b* of the outer lever 52. At this time, along with the rotation of the lever 50, the connecting portion between the lever 50 and the link 51 moves leftward and, also, the movable shaft 3 is pressed downward by the link 51. Thereafter, when the manipulation portion 52*a* is further pressed rightward, the connecting portion passes beyond the segment which connects the shaft 50*a* of the lever 50 and the shaft 51*a* of the link 51. At that moment, the connecting portion quickly moves leftward by spring force of a restoring spring (not shown). This is because the projection portion 52*b* of the outer lever 52 and the lever 50 are not connected to each other. As a consequence, the movable shaft 3 is pressed upward, and the movable contact point 20 is separated from the fixed contact points 21 (open state). At this time, the connecting portion is in contact with a left stopper 13, and this state is maintained by the spring force of the restoring spring (see FIG. 4B).

Figure 4B:
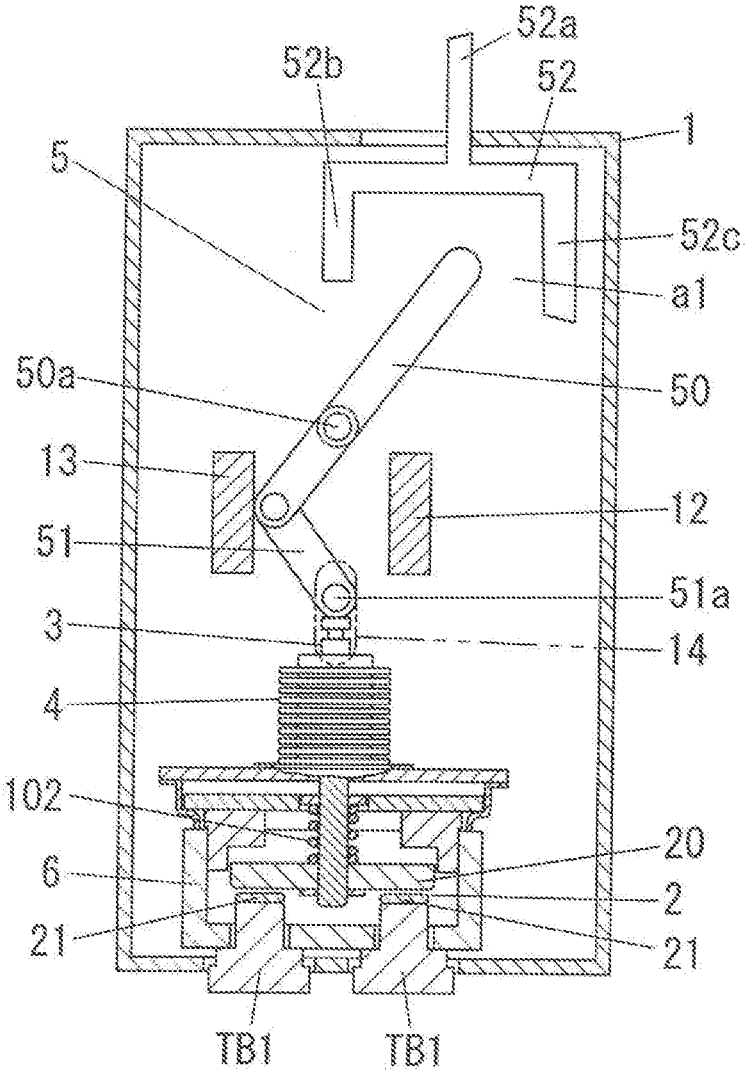

When the manipulation portion 52*a* of the outer lever 52 is pressed from the open state shown in FIG. 4B leftward (in the direction opposite to the arrow E in FIG. 4A), the lever 50 rotates in the counterclockwise direction while being pressed by the projection portion 52*c* of the outer lever 52. At this time, along with the rotation of the lever 50, the connecting portion between the lever 50 and the link 51 moves rightward and, also, the movable shaft 3 is pressed downward by the link 51. Then, when the manipulation portion 52*a* is further pushed leftward, the connecting portion passes beyond the segment which connects the shaft 50*a* of the lever 50 and the shaft 51*a* of the link 51. At that moment, the connecting portion quickly moves rightward by the spring force of the restoring spring. This is because the projection portion 52*c* of the outer lever 52 and the lever 50 are not connected to each other. As a result, the movable contact point 20 comes into contact with the fixed contact points 21 (closed state). At this time, the connecting portion is in contact with a right stopper 12, and this state is maintained by the spring force of the restoring spring. In addition, the movable contact point 20 is strongly adhered to the fixed contact points 21 by spring force of a contact pressure spring 102 (see FIG. 4A).

In this embodiment, the projection portions 52*b* and 52*c* (pressing unit) and the lever 50 are not connected to each other as described above, and a space a1 where the lever 50 moves is provided. Thus, when the connecting portion between the lever 50 and the link 51 passes beyond a predetermined position (segment which connects the shaft 50*a* of the lever 50 and the shaft 51*a* of the link 51), the connecting portion quickly moves toward the open direction of the contact unit 2 by the restoring spring. As a result, the interrupting performance of the contact unit 2 can be maintained, and arc occurring at the contact unit 2 can be quickly extinguished. In this embodiment, the connecting portion can also quickly move toward the closed direction of the contact unit 2 by the restoring spring, so that the occurrence of arc between the contact points 20 and 21 can be reduced. In this embodiment, the restoring spring serves as a biasing unit.

Figure 5A:
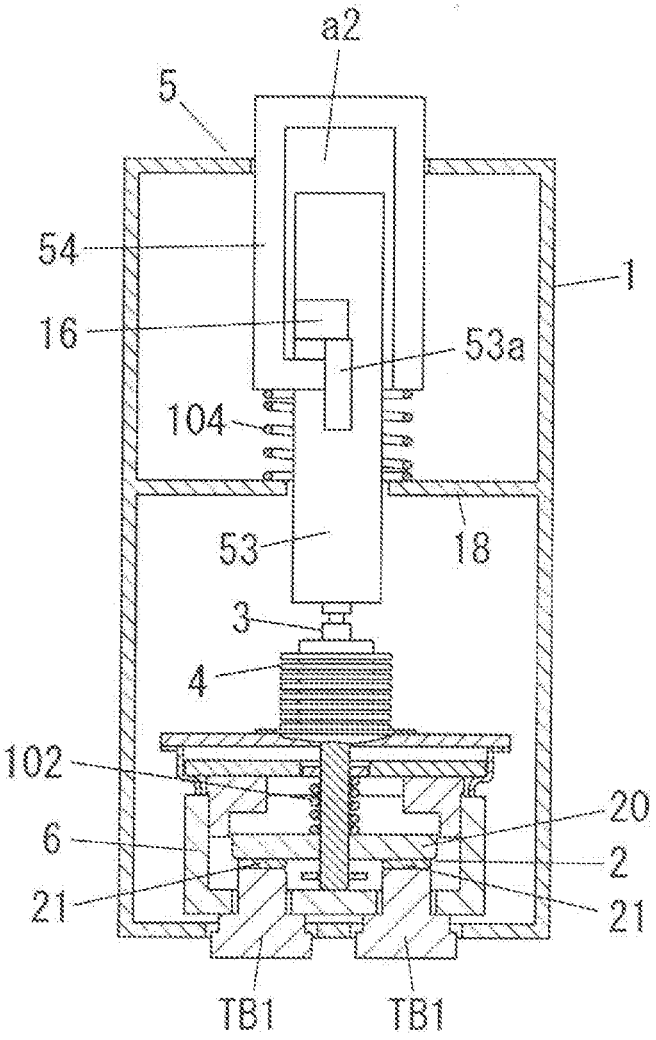
FIGS. 5A and 5B are schematic cross sectional views of a modification of the breaker of the second embodiment.
Figure 5B:
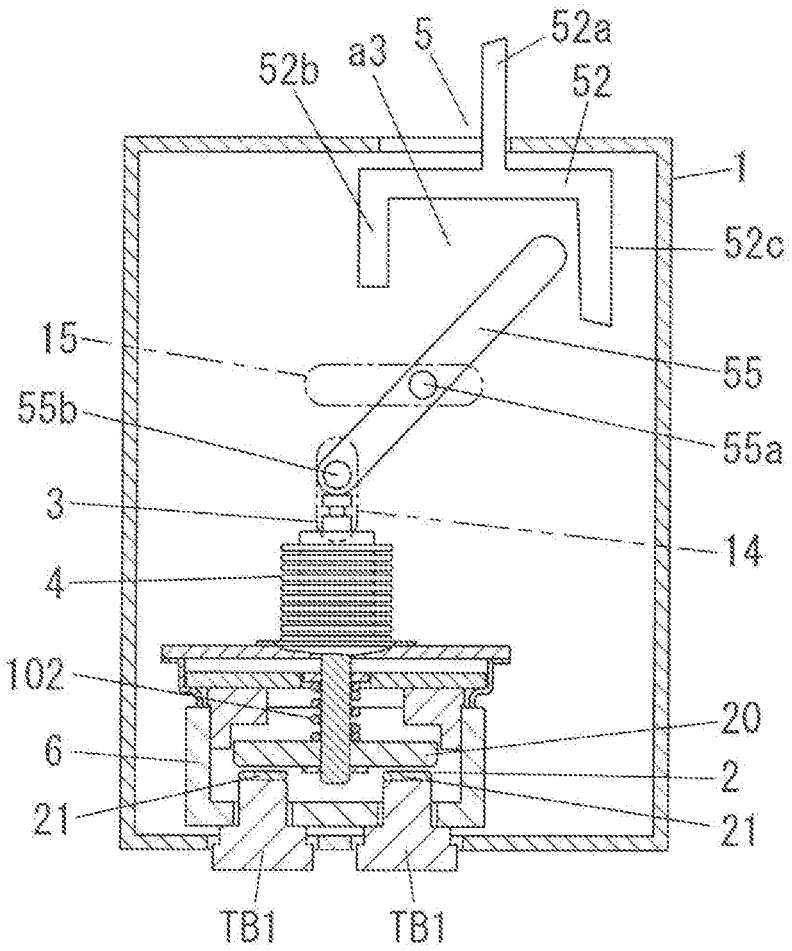

FIGS. 5A and 5B show modifications of the breaker of this embodiment. First, the breaker shown in FIG. 5A will be described. This breaker includes: a lever unit 5 having a cylindrical outer lever 54 having an open bottom; and an inner lever 53 capable of moving vertically by the movement of the outer lever 54. Upward elastic force is applied to the outer lever 54 by a biasing spring 104 having a lower end portion fixed to a support 18 provided at the base 1. Further, an engagement projection 53*a* projecting sideward is provided at the inner lever 53, and the upward movement of the inner lever 53 is restricted by engaging the engagement projection 53*a* to a lower edge of a stopper 16 formed at the base 1. Moreover, a leading end portion (bottom side in FIG. 5A) of the inner lever 53 is connected to the movable shaft 3.

The operation of this breaker will now be described. When the outer lever 54 is pressed downward (i.e., toward the inner side of the base 1) by a user, the inner lever 42 also moves downward along with the movement of the outer lever 54. At this time, the outer lever 54 is pressed until the engagement projection 53*a* of the inner lever 53 is located to a position lower than the stopper 16 of the base 1. Next, in this state, when the outer lever 54 is made to rotate in a predetermined direction, the engagement projection 53*a* of the inner lever 53 is engaged to the lower edge of the stopper 16 of the base 1, thereby restricting the upward movement of the inner lever 53. At last, when the user releases his/her hand from the outer lever 54, the outer lever 54 is restored to the initial position (shown in FIG. 5A) by the spring force of the biasing spring 104. At this time, the movable contact point 20 is brought into contact with the fixed contact points 21. In other words, the contact unit 2 reaches the closed state. In addition, a space a2 is provided between the outer lever 54 and the inner lever 53.

Next, when the outer lever 54 is made to rotate from the state shown in FIG. 5A in a direction opposite to the predetermined direction, the engagement between the engagement projection 53*a* of the inner lever 53 and the stopper 16 of the base 1 is released, and the inner lever 53 is pressed upward and restored to the initial position (i.e., the open state) by spring force of a restoring spring (not shown). At this time, the inner lever 53 can be quickly restored to the initial position due to the presence of the space a2 between the outer lever 54 and the inner lever 53. As a result, the interrupting performance of the contact unit 2 can be maintained, and the arc occurring at the contact unit 2 can be quickly extinguished. In this example, the bottom surface of the outer lever 54 serves as a pressing portion.

Hereinafter, the breaker shown in FIG. 5B will be described. This breaker includes the lever unit 5 having the outer lever 52 and an inner lever 55. A shaft 55*a* is provided in the middle of the lever 55 and can move in a horizontal direction along the guide groove 15 formed at the base 1. In addition, a shaft 55*b* is provided at a leading end portion of the inner lever 55 and can move in a vertical direction along the guide groove 14 formed at the base 1. Furthermore, the inner lever 55 is connected at its leading end portion to the movable shaft 5.

The following is description of the operation of the breaker. FIG. 5B describes an open state of the contact unit 2. When the manipulation portion 52*a* of the outer lever 52 in the open state is pressed leftward, the inner lever 55 rotates in the counterclockwise direction while being pressed by the projection portion (pressing portion) 52*c* of the outer lever 52. At this time, along with the rotation of the inner lever 55, the shaft 55*a* moves leftward along the guide groove 15 and, also, the shaft 55*b* moves downward along the guide groove 14. As a consequence, the movable shaft 3 is pressed downward. Then, when the manipulation portion 52*a* is further pressed leftward, the lever 55 passes beyond the vertical position thereof. At that moment, the inner lever 55 quickly rotates in the counterclockwise direction by spring force of a restoring spring (not shown). Further, at this time, the movable contact point 20 is in contact with the fixed contact points 21 (closed state).

When the manipulation portion 52*a* of the outer lever 52 in the closed state is pressed rightward, the inner lever 55 rotates in the clockwise direction while being pressed by the projection portion 52*b* of the outer lever 52. At this time, along with the rotation of the lever 55, the shaft 55*a* moves rightward along the guide groove 15 and, also, the shaft 55*b* moves downward along the guide groove 14. As a result, the movable shaft 3 is pressed downward. Next, if the manipulation portion 52*a* is pressed further rightward, the inner lever 55 passes beyond the vertical position thereof. At that moment, the inner lever 55 rotates quickly in the clockwise direction by the spring force of the restoring spring. As a result, the movable shaft 3 is pressed upward, and the movable contact point 20 is separated from the fixed contact points 21 (open state). In this example, the projection portions 52*b* and 52*c* of the outer lever 52 and the inner lever 55 are not connected to each other, and a space a3 where the lever 55 moves is provided therebetween. Therefore, the interrupting performance of the contact unit 2 can be maintained, and the arc occurring at the contact unit 2 can be quickly extinguished.

The structures of the outer lever and the inner lever are not limited to those described in this embodiment, and may be modified as long as the outer lever and the inner lever are not connected to each other and a space where the inner lever moves is provided.

Third Embodiment

A breaker in accordance with a third embodiment of the present invention will be described with reference to FIGS. 6 and 7. This embodiment is different from the second embodiment in that there is provided a locking mechanism for restricting movement of the outer lever 52 described in the second embodiment. Other configurations are the same as those of the second embodiment. Thus, like reference numerals will be given to like parts, and redundant description thereof will be omitted.

Figure 6A:
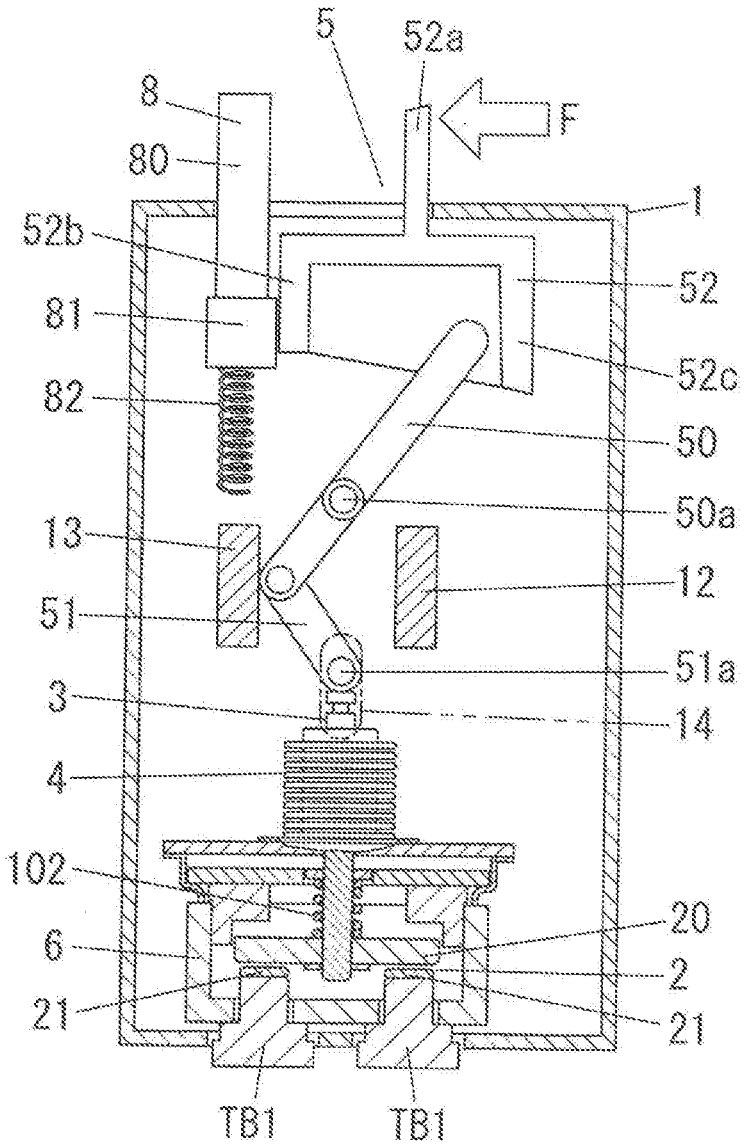

As described in FIG. 6A, the breaker of this embodiment includes a base 1, a contact unit 2, a movable shaft 3, a metal bellows 4, a lever unit 5 and a locking mechanism for restricting movement of an outer lever 52 of the lever unit 5.

As can be seen from FIG. 6A, the locking mechanism includes: a movement restricting portion 81 for restricting movement of the outer lever 52 in the open position (OFF position) toward the closed direction (ON direction); a locking body 8 having a push button 80 formed as a unit therewith and pressed by an operator to release the restriction of the movement restricting portion 81; and a biasing spring 82 disposed at a lower end portion of the locking body 8 to apply upward elastic force to the locking body 8. In this embodiment, the locking mechanism serves as a restricting unit.

Hereinafter, the operation of the breaker will be described with reference to FIGS. 6A and 6B. FIG. 6A shows an open state of the contact unit 2. When the outer lever 52 is moved from the open state leftward (in the direction indicated by the arrow F in FIG. 6A), the contact unit 2 reaches the closed state. In this embodiment, however, the outer lever 52 cannot be moved due to the presence of the locking mechanism. Thus, in the breaker of this embodiment, it is necessary to release the locking mechanism before moving the outer lever 52.

To be specific, in order to release the locking state, first, the movement restricting portion 81 is moved to a position below the projection portion 52*b* by pressing downward the push button 80 of the locking body 8. In that state, when the manipulation portion 52*a* of the outer lever 52 is pressed leftward (in the direction indicated by the arrow F in FIG. 6A), the lever 50 rotates in the counterclockwise direction about the shaft 50*a* while being pressed by the projection portion 52*c* of the outer lever 52. At this time, along with the rotation of the lever 50, the connecting portion between the lever 50 and the link 51 moves rightward and, also, the movable shaft 3 is pressed downward by the link 51. Next, when the manipulation portion 52*a* is further pressed leftward, the connecting portion passes beyond the segment which connects the shaft 50*a* of the lever 50 and the shaft 51*a* of the link 51. At that moment, the connecting portion moves quickly rightward by spring force of a restoring spring (not shown). This is because the projection portion 52*c* of the outer lever 52 and the lever 50 are not connected to each other. As a result, the movable contact point 20 is brought into contact with the fixed contact points 21 (closed state) (see FIG. 6B).

At this time, the connecting portion is in contact with a right stopper 12, and this state is maintained by the spring force of the restoring spring. Further, the movable contact point 20 is press-contacted to the fixed contact points 21 by the spring force of the contact pressure spring 102. Moreover, the movement restricting portion 81 of the locking body 8 is in elastic contact with the lower edge of the outer lever 52 by the spring force of the biasing spring 82 (see FIG. 6B).

Figure 6B:
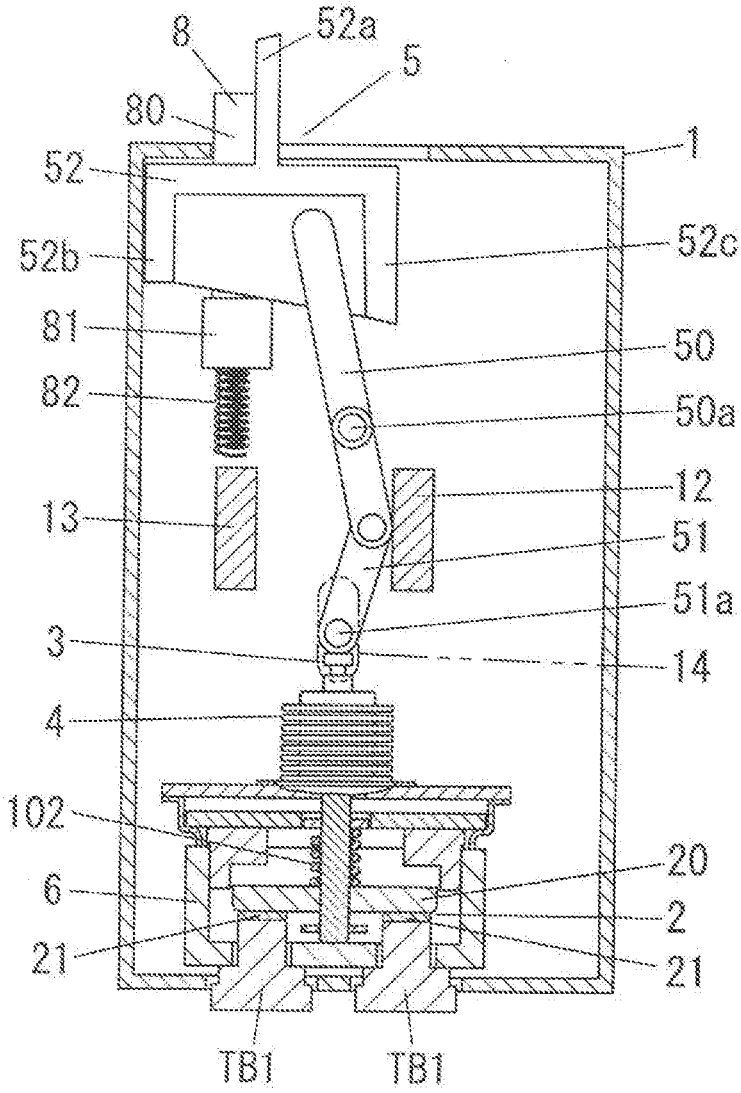

When the manipulation portion 52*a* of the outer lever 52 in the closed state shown in FIG. 6B is pressed rightward (in the direction opposite to the arrow F in FIG. 6A), the lever 50 rotates in the clockwise direction while being pressed by the projection portion 52*b* of the outer lever 52. At this time, along with the rotation of the lever 50, the connecting portion between the lever 50 and the link 51 moves leftward and, also, the movable shaft 3 is pressed downward by the link 51. Thereafter, if the manipulation portion 52*a* is pressed further rightward, the connecting portion passes beyond the segment which connects the shaft 50*a* of the lever 50 and the shaft 51*a* of the link 51. At that moment, the connecting portion quickly moves leftward by the spring force of the restoring spring. This is because the projection portion 52*c* of the outer lever 52 and the lever 50 are not connected to each other. As a result, the movable shaft 3 is pressed upward, and the movable contact point 20 is separated from the fixed contact points 21 (open state).

At this time, the connecting portion is in contact with a left stopper 13, and this state is maintained by the spring force of the restoring spring (see FIG. 6A). Further, the upward elastic force is applied to the movement restricting portion 81 of the locking body 8 by the spring force of the biasing spring 82, so that the locking body 8 is restored to the locking position (restriction position) shown in FIG. 6A. In addition, the position of the locking body 8 shown in FIG. 6B is set to the release position.

In accordance with this embodiment, the locking mechanism (the locking body 8 and the biasing spring 82) can prevent the lever unit 5 (the outer lever 52) from being accidentally manipulated, so that the breaker has a high safety.

Figure 7A:
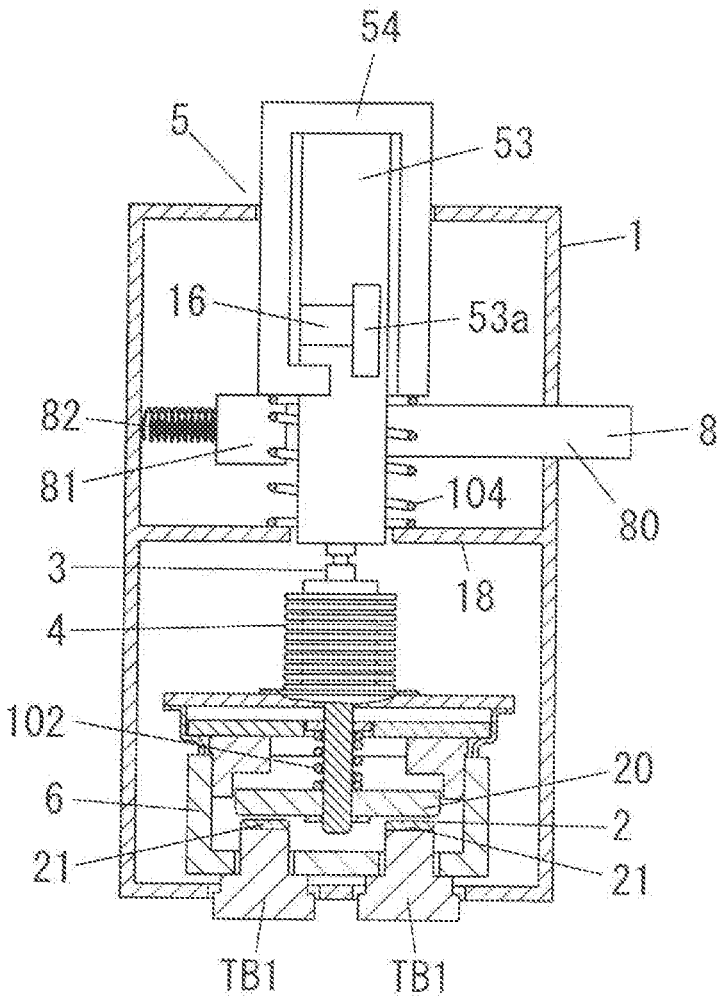
FIGS. 7A and 7B are schematic cross sectional views of a modification of the breaker of the third embodiment.
Figure 7B:
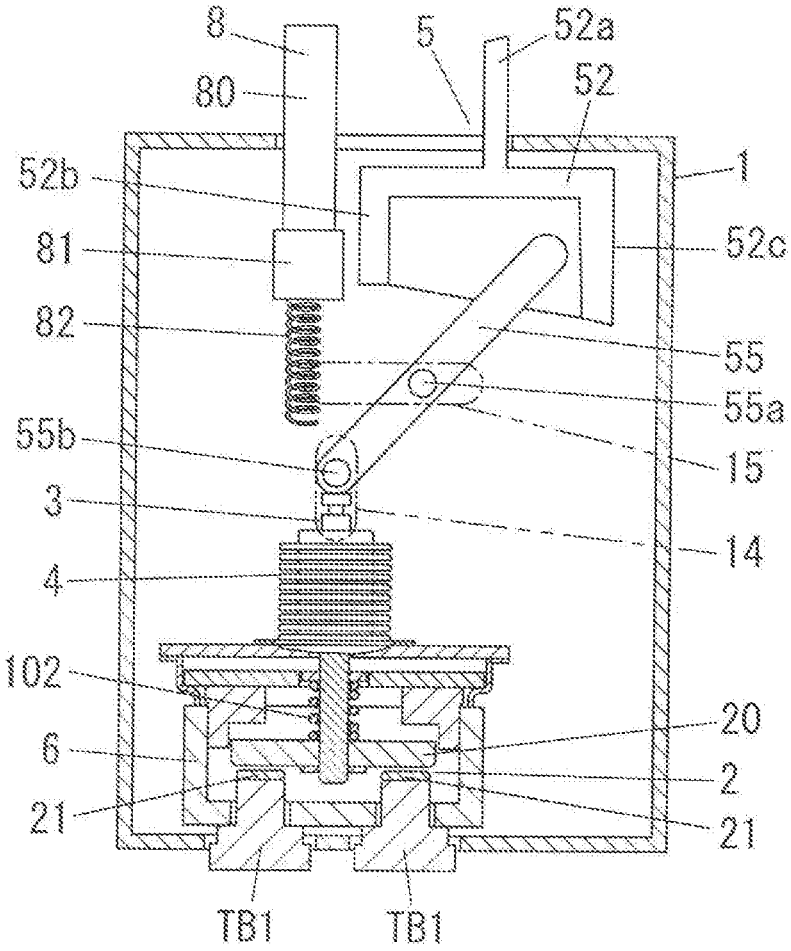

FIGS. 7A and 7B illustrate a modification of the breaker of this embodiment which is different from the breaker described in FIGS. 5A and 5B in that a locking mechanism (the locking body 8 and the biasing spring 82) is provided. Other configurations are the same as those shown in FIGS. 5A and 5B. Hence, like reference numerals will be given to like parts, and redundant description thereof will be omitted.

The breaker of FIG. 7A includes a push button 80 projecting sideward from the base 1 and a locking mechanism. The locking mechanism includes: a locking body 8 having a movement restricting portion 81 formed as a unit therewith to restrict downward movement of the outer lever 54; and a biasing spring 82 disposed at a left end portion of the locking body 8 to apply rightward elastic force to the locking body 8. When the push button 80 of the locking body 8 is not pressed, the downward movement of the outer lever is restricted as shown in FIG. 7A. However, the engagement between the outer lever 54 and the movement restricting portion 81 can be released by pressing the push button 80 leftward and, therefore, the outer lever 54 can be pressed downward. The operations executed after pressing the push button 80 are the same as those described in FIG. 5A, so that the description thereof will be omitted.

The breaker of FIG. 7B includes a push button 80 projecting outward from the top of the base 1 and a locking mechanism. The locking mechanism includes: a locking body 8 having a movement restricting portion 81 formed as a unit therewith to restrict movement of the outer lever 52 in the open position (OFF position) in the closed direction (ON direction); and a biasing spring 82 disposed at a lower end portion of the locking body 8 to apply upward elastic force to the locking body 8. When the push button 80 of the locking body 8 is not pressed, the movement of the outer lever 52 toward the ON direction is restricted. However, the engagement between the outer lever 52 and the movement restricting portion 81 can be released by pressing the push button 80 downward and, hence, the outer lever 52 can move in the ON direction (leftward). The operations executed after pressing the push button 80 are the same as those described in FIG. 5B, so that the description thereof will be omitted.

As described above, the locking mechanism (the locking body 8 and the biasing spring 82) of the breaker can prevent accidental manipulation of the lever unit 5. Accordingly, the breaker has a high safety.

The locking mechanism described in this embodiment is only an example, and can be modified as long as the operation of the lever unit can be restricted.

Fourth Embodiment

A breaker in accordance with a fourth embodiment of the present invention will be described with reference to FIGS.

8A to 10C. This embodiment is different from the third embodiment in that there is provided a latch body (latch unit) 9 for maintaining the locking body 8 in the release position where the locking of the locking mechanism is released. Other configurations are the same as those of the third embodiment. Therefore, like reference numerals will be given to like parts, and redundant description thereof will be omitted.

Figure 10A:
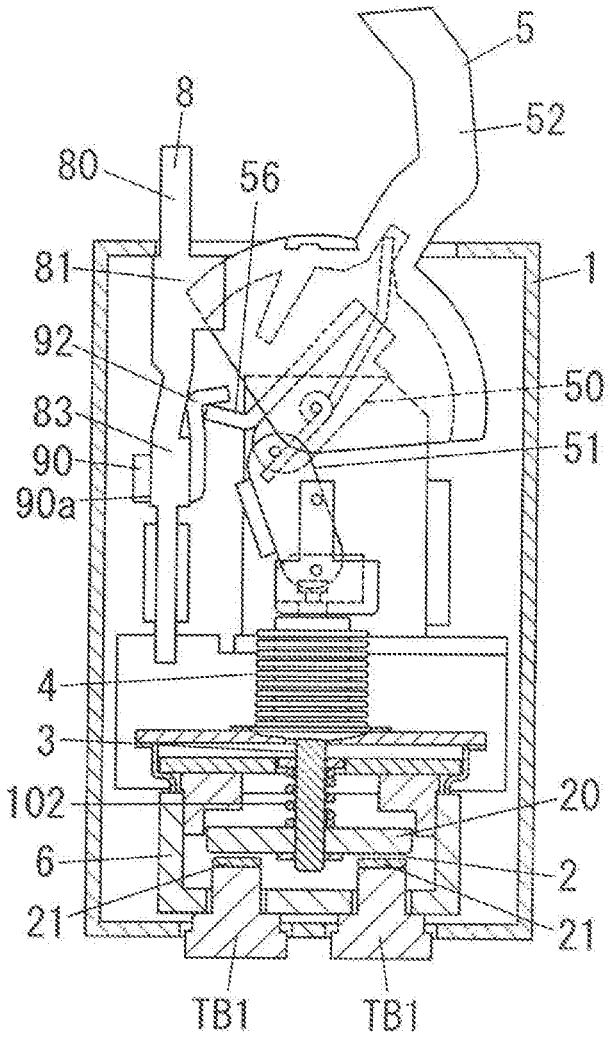
FIGS. 10A to 10C present explanatory views for explaining an operation of the latch body used in the fourth embodiment.
Figure 10B:
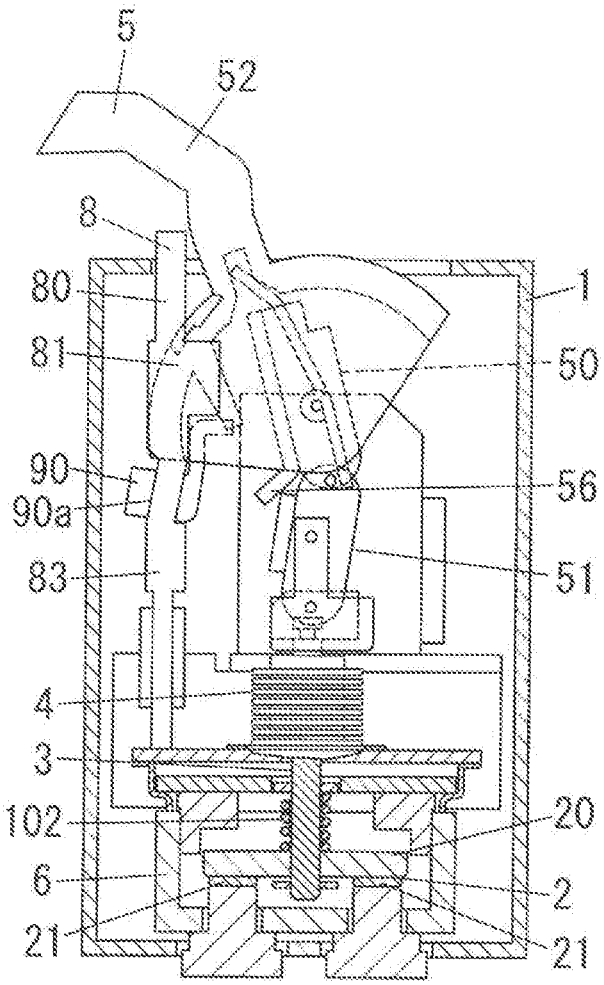

As shown in FIG. 10A, the breaker of this embodiment includes a base 1, a contact unit 2, a movable shaft 3, a metal bellows 4, a lever unit 5, a locking mechanism having a locking body 8 and a biasing spring 82, and the latch body for maintaining the locking body 8 in a predetermined release position (position shown in FIG. 10B).

Figure 8A:
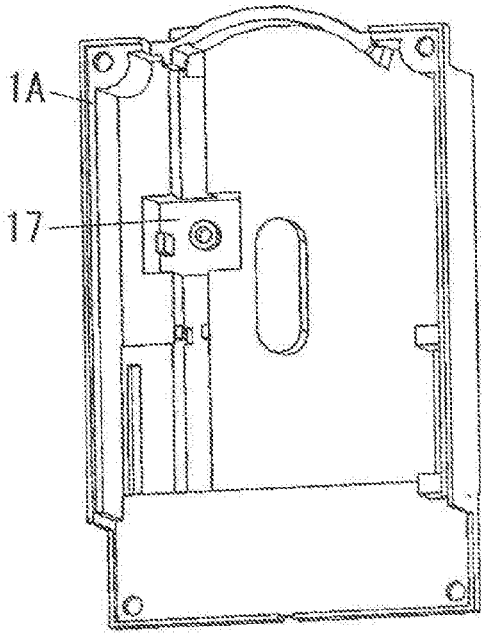
FIGS. 8A to 8C present explanatory views for explaining processes for attaching, to a base, a latch body and a locking mechanism used for a breaker in accordance with a fourth embodiment of the present invention.

As illustrated in FIG. 8A, a recess portion 17 for receiving the latch body 9 and the locking mechanism (the locking body 8 and the biasing spring 82) is provided at an inner side surface of a base piece 1A along the vertical direction. Further, a bearing (not shown) for axially supporting a shaft 91 which will be described later is provided at an inner side surface of a base piece 1B (see FIG. 2).

Figure 9A:
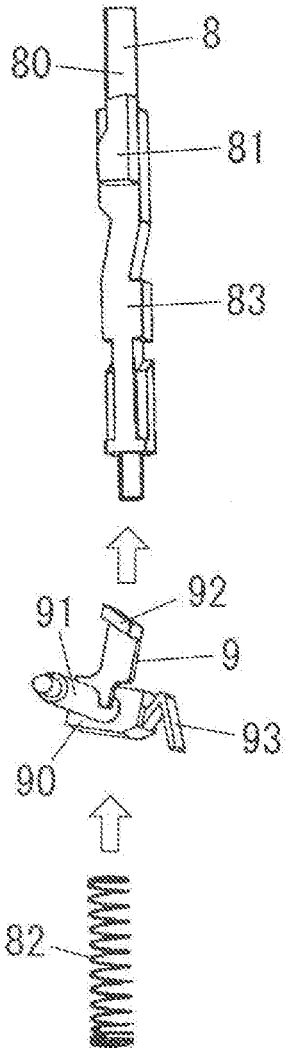
FIG. 9A describes an exploded perspective view of the latch body and the locking mechanism used in the fourth embodiment, and FIG. 9B describes a perspective view of the latch body.
Figure 9B:
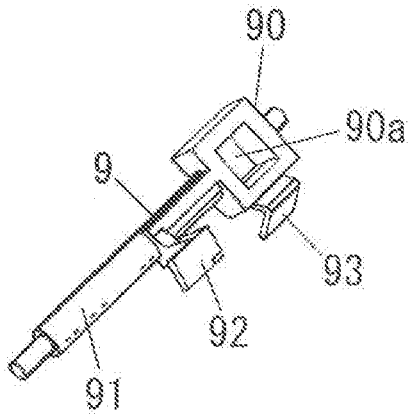

Meanwhile, as shown in FIG. 9A, the locking mechanism includes: a movement restricting portion 81 for restricting movement of the outer lever 52; a push button 80 pressed by an operator to release the restriction of the movement restricting portion 81; a locking body 8 having an engaged portion 83 that is formed as a unit therewith and maintained in the release position by the latch body 9; and a biasing spring 82. Moreover, as depicted in FIGS. 9A and 9B, the latch body 9 includes: a rectangular frame-shaped engaging portion 90 for holding the engaged portion 83 of the locking body 8 in the release position; a shaft 91 projecting from the engaging portion 90 in a thickness direction of the base 1; a latch releasing portion 92 provided in the middle of the shaft 91 to release the state in which the engaged portion 83 is latched by the engaging portion 90; and a spring piece 93. Further, an approximately rectangular through hole 90*a* through which the locking body 8 passes is formed at a central portion of the engaging portion 90.

Figure 8B:
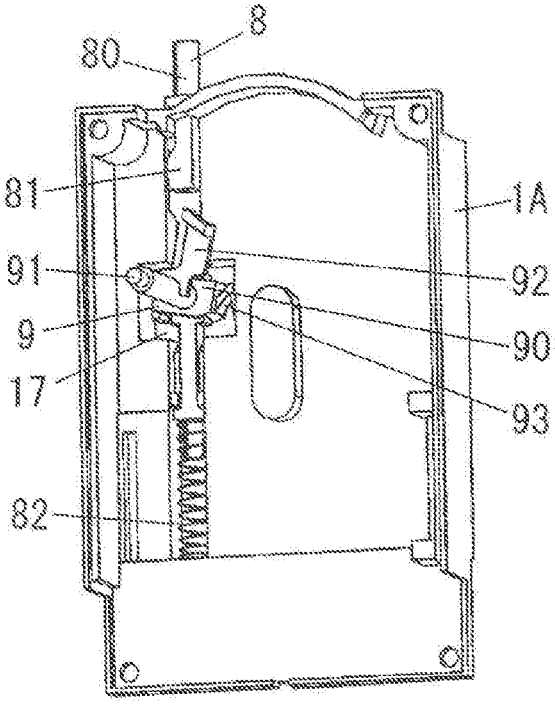
Figure 8C:
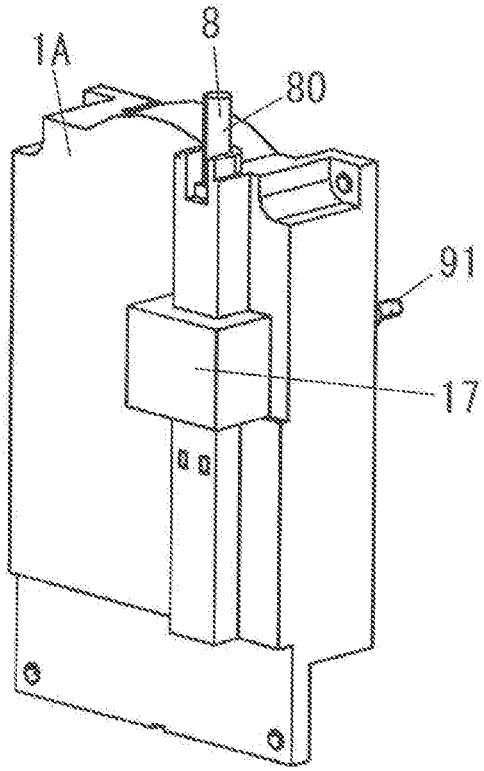

The locking mechanism and the latch body 9 are attached to the base 1 as will be described hereinafter. First, the locking body 8 is inserted from the top into the through hole 90*a* formed at the engaging portion 90 of the latch body 9 to thereby assemble the locking mechanism and the latch body 9. The locking mechanism and the latch body 9 assembled as one unit is disposed at the recess portion 17 and, then, the biasing spring 82 is attached to the lower end portion of the locking body 8. In this manner, the attachment of the locking mechanism and the latch body 9 to the base 1 is completed (see FIG. 8B). At this time, the push button 80 of the locking body 8 projects outward from the front surface of the base 1, as illustrated in FIGS. 8B and 8C.

In addition, the latch body 9 is rotatably supported at the base 1 by the shaft 91 and can rotate between the release position for supporting the engaged portion 83 of the locking body 8 (the position at which the locking of the locking mechanism is released, i.e., the position shown in FIG. 10B) and the locking position where the engaged portion is not held (the restriction position at which the movement of the outer lever 52 is restricted by the locking mechanism, i.e., the position shown in FIG. 10A). Here, the spring piece 93 serves to hold the position of the engaging portion 90. When holding the locking body 8, the engaging portion 90 is inclined as shown in FIGS. 10B and 10C, and the upward movement of the locking body 8 is restricted.

Hereinafter, the operation of the breaker will be described with reference to FIGS. 10A to 10C. FIG. 10A shows an open state of the contact unit 2. At this time, the movement of the outer lever 52 of the lever unit 5 is restricted by the locking mechanism. Further, the engaged portion 83 of the locking body 8 is inserted in the through hole 90*a* of the engaging portion 90 of the latch body 9. If the push button 80 of the locking body 8 is pressed downward in that state, the engaged portion 83 moves downward out of the through hole 90*a* of the engaging portion 90, and the engaging portion 90 is inclined by the spring force of the spring piece 93 to thereby hold the engaged portion 83 of the locking body 8. Thereafter, if the outer lever 52 is made to rotate in the counterclockwise direction, the movable contact point 20 is brought into contact with the fixed contact points 21 via the aforementioned operations and reaches the closed state (see FIG. 10B).

When the outer lever 52 is made to rotate from the closed state shown in FIG. 10B in the clockwise direction, the contact unit 2 reaches the open state. At this time, however, the lever 50 also rotates, and the latch releasing portion 92 is pressed upward by a releasing lever (releasing portion) 56 provided at the lever 50. Hence, the engaging portion 90 rotates in the counterclockwise direction against the spring force of the spring piece 93, and the latch state is released. As a consequence, the locking body 9 is pressed upward by the spring force of the biasing spring 82, and the locking body 8 is positioned in the locking position (see FIG. 10A).

Figure 10C:
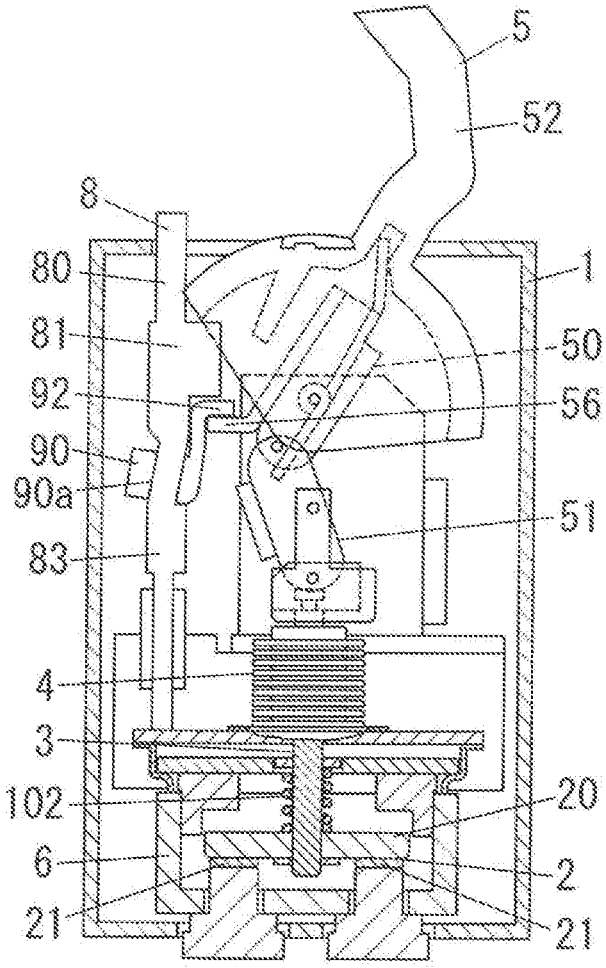

FIG. 10C shows a state where the contact unit 2 is thermally bonded by, e.g., an over current. At this time, an over current protection function acts and, thus, the outer lever 52 moves in the open direction. Since, however, the contact unit 2 is thermally bonded, the outer lever 52 does not move to the open position. Accordingly, the latch releasing portion 92 of the latch body 9 is not pressed upward by the releasing lever 56. As a result, the latch of the locking body 8 is not released, and the locking body 8 is maintained in the release position. In other words, whether the contact unit 2 is in a normal open state or is thermally bonded can be recognized from the position of the outer lever 52 and that of the push button 80 of the locking body 8.

In accordance with this embodiment, when the contact unit 2 is thermally bonded by, e.g., an over current, the lever 50 cannot move to the open position. Therefore, the latch of the locking body 8 is not released by the releasing lever 56, and the locking body 8 is maintained in the release position. On the other hand, the outer lever 52 moves to the open position along with the movement of the lever 50. Accordingly, an operator can recognize the thermal bonding of the contact unit 2 by checking the positions of the outer lever 52 and the push button 80 of the locking body 8.

The locking mechanism and the latch unit of this embodiment are only examples and can be modified as long as the manipulation of the lever unit can be restricted by the locking mechanism and the locking mechanism can be maintained in the predetermined release position by the latch unit.

Fifth Embodiment

A breaker in accordance with a fifth embodiment of the present invention will be described with reference to FIGS. 11, 12A and 12B. This embodiment is characterized in that a biasing spring 100 for pressing the outer lever 52 to the inner lever (the lever 50 and the link 51) is provided at the inner lever and also in that an auxiliary contact unit 101 for outputting a predetermined electric signal to the outside in accordance with an opening/closing state of the contact unit 2. Like reference numerals will be given to the same parts as those of the aforementioned embodiments, and redundant description thereof will be limited.

Figure 11:
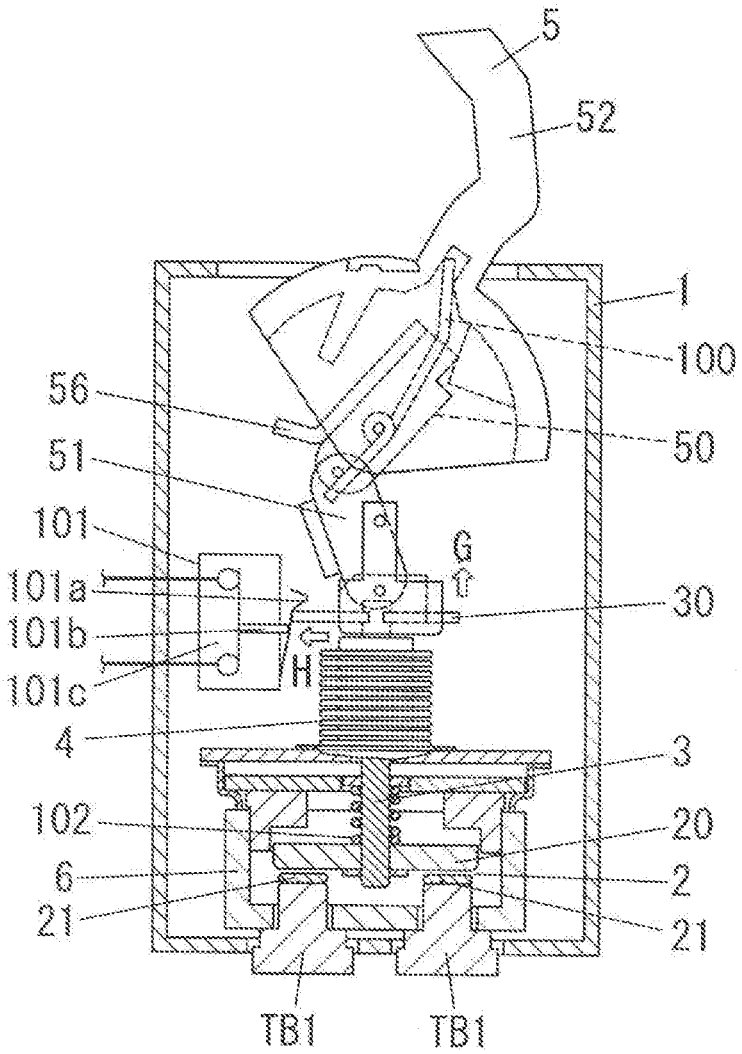
FIG. 11 is a schematic cross sectional view showing an open state of a breaker in accordance with a fifth embodiment of the present invention.

As shown in FIG. 11, the breaker of this embodiment includes a base 1, a contact unit 2, a movable shaft 3, a metal bellows 4, a lever unit 5, and the auxiliary contact unit 101 for outputting a predetermined electric signal to the outside in accordance with the opening/closing state of the contact unit 2.

A biasing spring (third biasing spring) 100 is attached to the shaft 50*a* of the lever 50 forming the inner lever of the lever unit 5, and the outer lever 52 is pressed to the inner lever (the lever 50) by the spring force of the biasing spring 100. As a result, relative movement between the inner lever and the outer lever 52 can be prevented, and noise can be reduced even when the breaker is installed in, e.g., a location where vibration is strong.

In this embodiment, a switch plate 30 that moves vertically along with the movement of the movable shaft 3 is attached to a protruded portion of the movable shaft 3 (portion protruded outward from the airtight container 6). Further, when a switch lever 101*a* of the auxiliary contact unit 101 is pressed leftward by the switch plate 30, an inner contact point 101*c* is closed and a predetermined electric signal is output to the outside.

Next, the operation of the breaker will be described with reference to FIG. 11. FIG. 11 shows the open state of the contact unit 2. At this time, the switch plate 30 is moved upward (in the direction indicated by the arrow G in FIG. 11), so that the switch lever 101*a* is pressed leftward (in the direction indicated by the arrow H in FIG. 10). As a consequence, the inner contact point 101*c* is closed by a pressing plate 101*b*. When the outer lever 52 is made to rotate from that state in the counterclockwise direction, the movable shaft 3 is pressed downward via the lever 50 and the link 51, and the contact unit 2 reaches the closed state. At this time, the switch plate 30 attached to the movable shaft 3 is also moved downward. Thus, the pressing force of the switch plate 30 is released, and the switch lever 101*a* is restored rightward. As a result, the inner contact point 101*c* is opened. In other words, in this embodiment, when the contact unit 2 is in the open state, the inner contact point 101*c* is closed and, thus, the electric signal is output. On the other hand, when the contact unit 2 is in the closed state, the inner contact point 101*c* is opened and, hence, the electrical signal is not output. For that reason, an operator can recognize the state of the contact unit 2 by the existence/nonexistence of the electric signal.

Figure 12A:
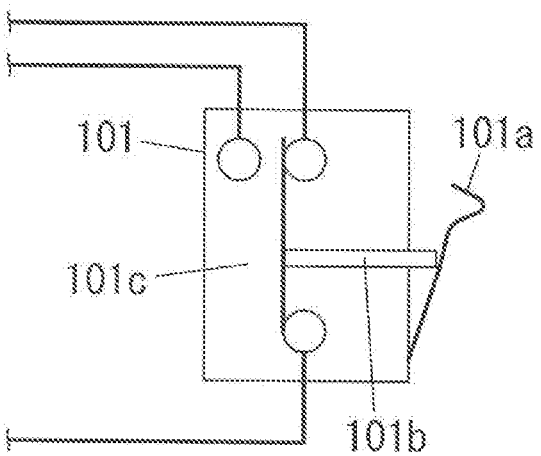
FIGS. 12A and 12B schematically shows another auxiliary contact unit used in the fifth embodiment.
Figure 12B:
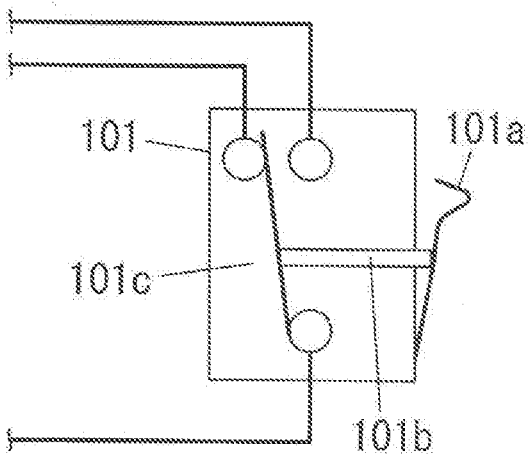

Although the auxiliary contact unit 101 having "a" type of contact point has been described in this embodiment, the auxiliary contact unit 101 may have, e.g., "b" type of contact point or "c" type of contact point (including the "a" type of contact point" and the "b" type of contact point) as shown in FIGS. 12A and 12B. In that case as well, the state of the contact unit 2 can be recognized by the electric signal output from the auxiliary contact unit 101.

Sixth Embodiment

A breaker in accordance with a sixth embodiment of the present invention will be described with reference to FIGS. 13A to 15C. As shown in FIGS. 13A to 13D, this embodiment is characterized in that a recess 52*d* is formed at the outer lever 52 so that a gap can be provided between the outer lever 52 and the locking body 8 when the locking body 8 for restricting movement of the outer lever 52 is in the release position. Like reference numerals will be given to the same parts as those of the aforementioned embodiments, and redundant description thereof will be omitted.

Figure 15A:
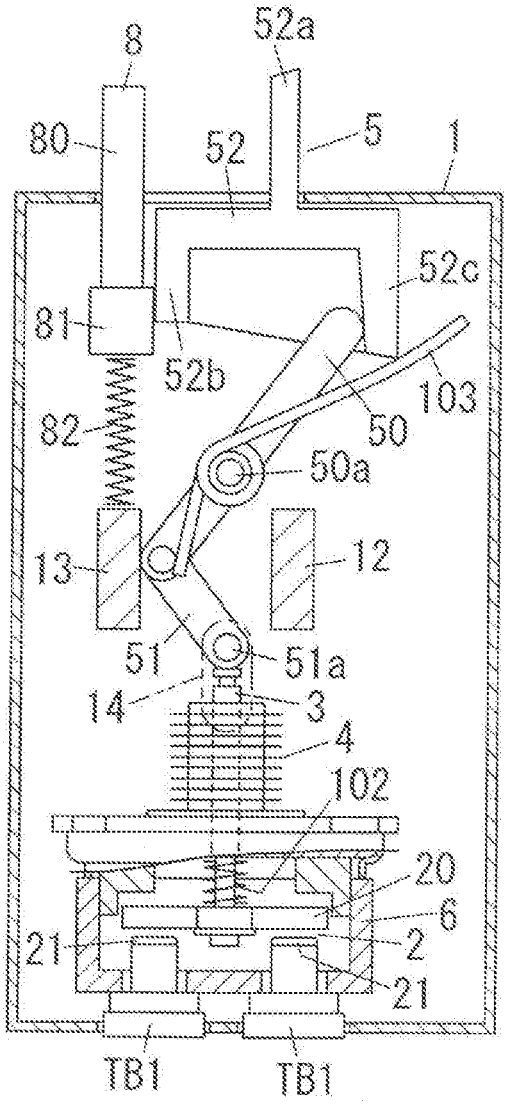
FIGS. 15A to 15C present explanatory views of explaining an operation of a comparative example of the fifth embodiment.
Figure 15B:
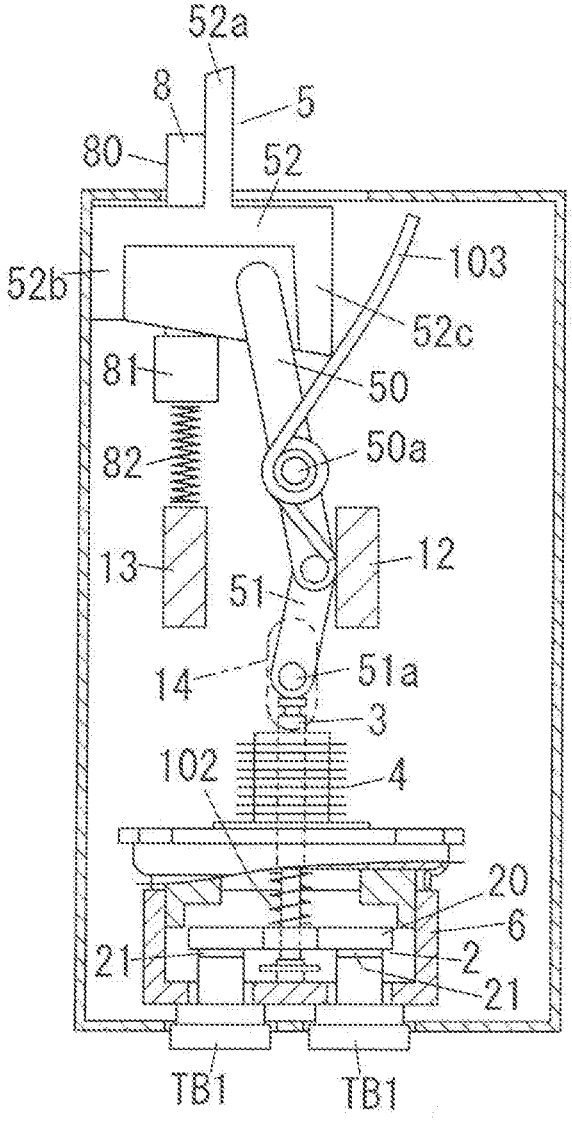
Figure 15C:
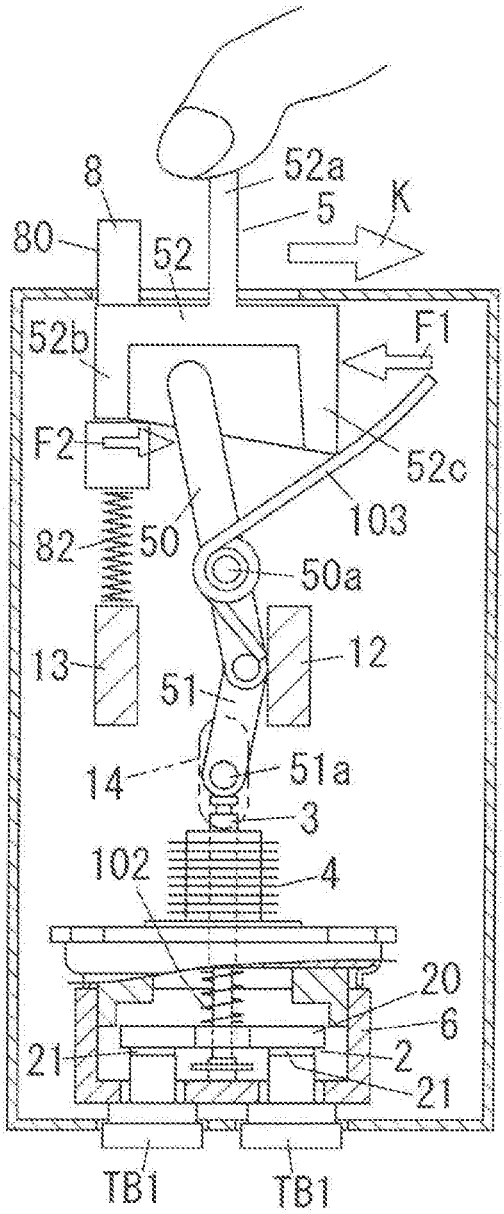

The breaker shown of FIGS. 15A to 15C has a configuration in which a biasing spring 103 is added to the breaker of FIG. 6. Therefore, even when the manipulation of the outer lever 52 in the right direction (OFF direction) is stopped halfway, for example, the outer lever 52 can be automatically restored leftward (ON direction) by the biasing spring 103. FIG. 15A shows a state where the leftward movement of the outer lever 52 is restricted by the movement restricting portion 81 of the locking body 8. At this time, the contact unit 2 is in the open state (in which the movable contact point 20 is separated from the fixed contact points 21). When the push button 80 of the locking body 8 is pressed downward in that state, the outer lever 52 is moved leftward by the elastic force applied from the biasing spring 103, as can be seen from FIG. 15B. At this time, the movable contact point 20 comes into contact with the fixed contact points 20 and reaches the closed state via the aforementioned processes. Further, the upward elastic force is applied from the biasing spring 82 to the locking body 8, and the lower edge of the outer lever 52 becomes in elastic contact with the upper edge of the movement restricting portion 81.

Here, if a hand is released from the outer lever 52 while the outer lever 52 is moving from the ON state shown in FIG. 15B in the OFF direction (in the direction indicated by the arrow K in FIG. 15C) by manipulating the manipulation portion 52*a* (i.e., if the OFF operation is stopped halfway), the outer lever 52 is biased to return to the original ON position (shown in FIG. 15B) by the biasing spring 103 as described above. At this time, friction force F2 is applied to the outer lever 52 by the elastic force of the biasing spring 82. Therefore, in order to automatically return the outer lever 52 to the ON position, the elastic force F1 applied to the outer lever 52 by the biasing spring 103 needs to be greater than the friction force F2. As a result, in order to automatically return the outer lever 52 to the ON position by the biasing spring 103, the spring force of the biasing spring 103 needs to be increased, and manipulability may deteriorate due to the increased spring force of the biasing spring 103.

Figure 13A:
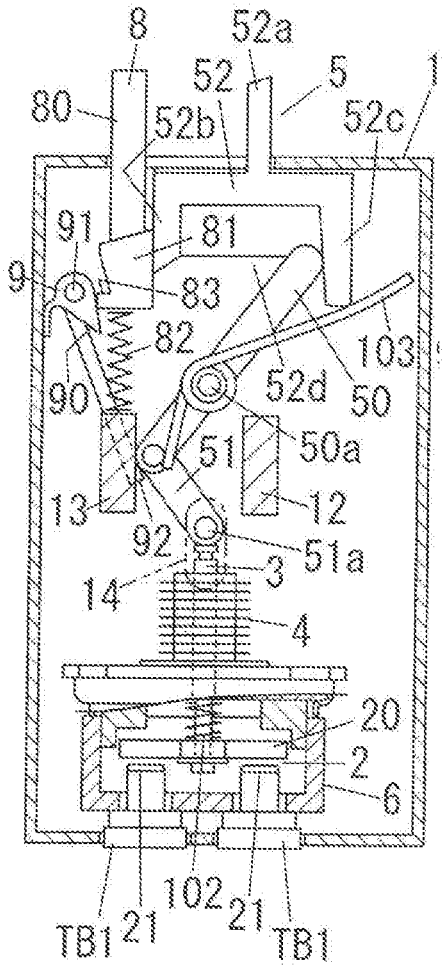
FIGS. 13A to 13D present explanatory views for explaining an operation of a breaker in accordance with a sixth embodiment of the present invention.
Figure 13B:
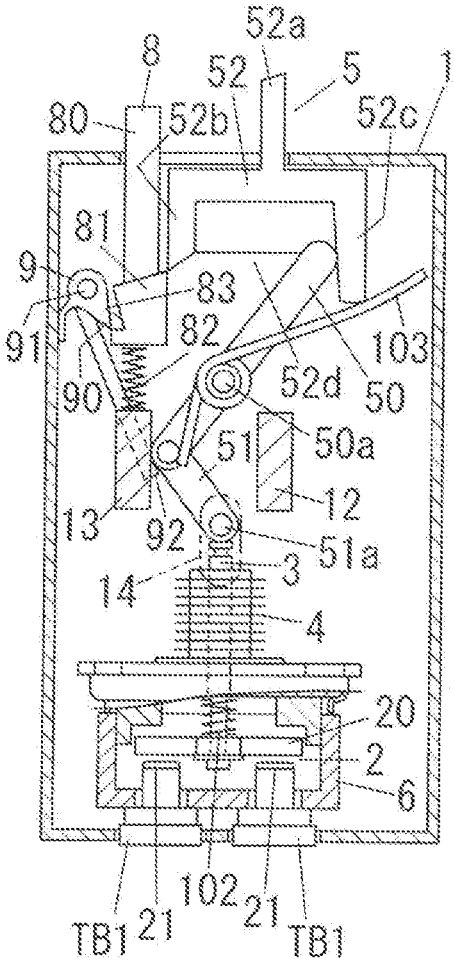

In view of the above, this embodiment provides a breaker shown in FIGS. 13A to 13D to solve the above-described problems. As depicted in FIG. 13A, the breaker includes a base 1, a contact unit 2, a movable shaft 3, a metal bellows 4, a lever unit 5, a locking mechanism having a locking body 8 and a biasing spring (first biasing spring) 82, a latch body (latch unit) 9 for maintaining the locking body 8 in the release position, and a biasing spring (second biasing spring) 103 for applying elastic force of a predetermined direction (leftward in the example shown in FIG. 13A) to the outer lever 52 of the lever unit 5. Moreover, the biasing spring 103 serves as a third biasing spring for pressing the outer lever 52 to the lever 50 of the inner lever. In this embodiment, the locking mechanism serves as a restricting unit.

Figure 13C:
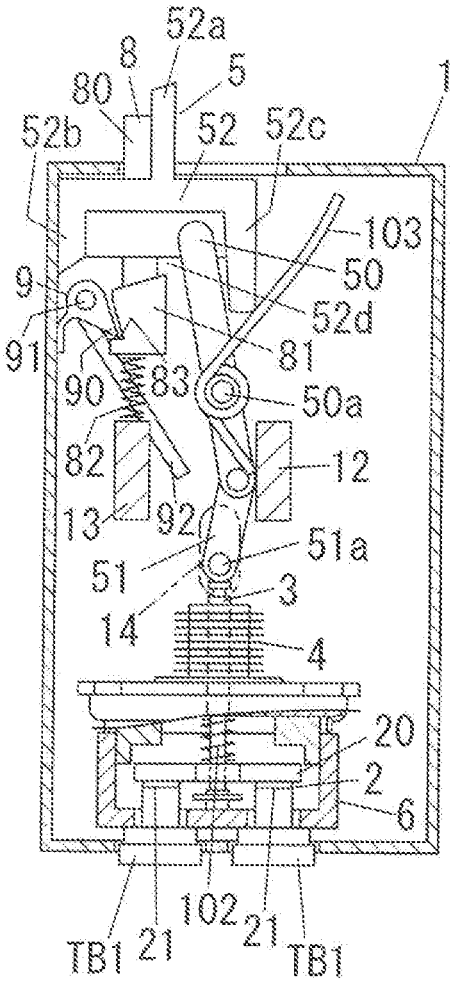
Figure 13D:
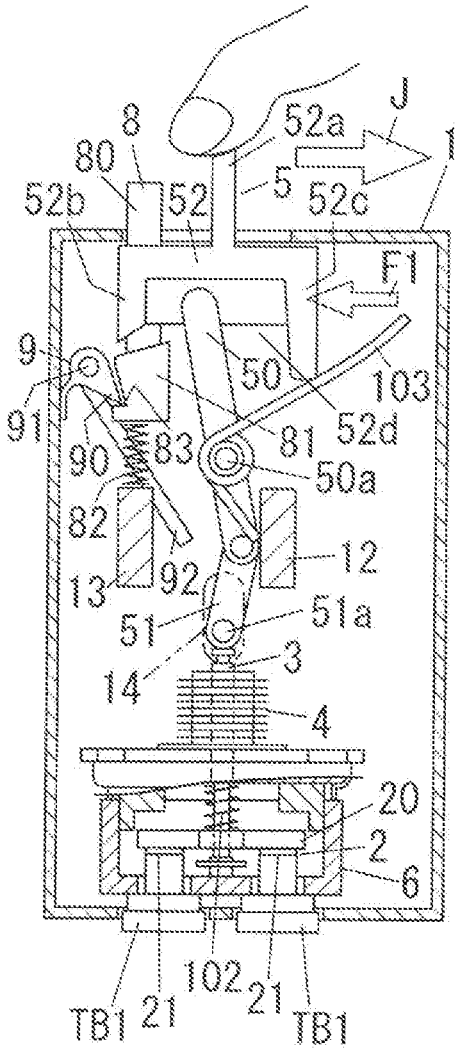

A recess 52*d* is formed at the lever 52 so that a gap can be provided between the outer lever 52 and the movement restricting portion 81 of the locking body 8 when the locking body 8 is maintained in the release position by the latch body 9 (in the state shown in FIG. 13C). In the release state, the outer lever 52 does not contact with the movement restricting portion 81 during the horizontal movement. In other words, in the release state, the friction force F2 is not generated when the outer lever 52 moves.

Next, the operation of the breaker will be described. FIG. 13A depicts a state where the movement of the outer lever 52 in the left direction (ON direction) is restricted by the movement restricting portion 81 of the locking body 8. At this time, the contact unit 2 is in the open state. The position of the locking body 8 at that time is set to the restriction position. If the push button 80 of the locking body 8 is pressed downward in that state, the movement restricting portion 81 is held by the engagement of the engaged portion 83 of the locking body 8 with the engaging portion 90 of the latch body 9, as can be seen from FIG. 13B. Here, even if the locking body 8 is pressed upward by the biasing spring 82, the locking body 8 cannot move upward by the engagement of the engaging portion 90 of the latch body 9 and the engaged portion 83 of the locking body 8. The position of the locking body 8 at that time is set to the release position. Meanwhile, the outer lever 52 moves leftward by the leftward elastic force applied from the biasing spring 103. as illustrated in FIG. 13C. At this time, the movable contact point 20 comes into contact with the fixed contact points 21 and reaches the closed state through the aforementioned processes.

If the user releases his/her hand from the outer lever 52 while the outer lever 52 is moved from the ON state shown in FIG. 13C in the OFF direction (in the direction indicated by the arrow J in FIG. 13D) by manipulating the manipulation portion 52*a*, the outer lever 52 is moved to return to the original ON position (position shown in FIG. 13C) by the spring force of the biasing spring 103. At this time, in the breaker shown in FIGS. 15A to 15C, the friction force F2 acts between the outer lever 52 and the movement restricting portion 81 and, thus, the biasing force F1 applied to the outer lever 52 by the biasing spring 103 needs to be greater than the friction force F2. In the present embodiment, however, the outer lever 52 is not in contact with the movement restricting portion 81, so that the friction force F2 is not generated. For that reason, the friction force F1 applied to the outer lever 52 by the biasing spring 103 may be small.

When the outer lever 52 moves from the closed state rightward (in the OFF direction), the lever 50 is pressed rightward by the projection portion 52*b* of the outer lever 52 and, hence, the connecting portion between the lever 50 and the link 51 moves leftward. Next, when the outer lever 52 moves rightward, the connecting portion is brought into contact with the left stopper 13 through the aforementioned processes (see FIG. 13B). At this time, the latch releasing portion 92 of the latch body 9 is pressed leftward by the connecting portion, so that the latch body 9 rotates in the clockwise direction about the shaft 91. Accordingly, the engagement between the engaged portion 83 of the locking body 8 and the supporting unit 90 of the latch body 9 is released, and the locking body 8 returns to the predetermined restriction position by the upward spring force of the biasing spring 82 (see FIG. 13A). At this time, the movable contact point 20 is separated from the fixed contact points 21 through the aforementioned processes. Further, the leftward elastic force is applied from the biasing spring 103 to the outer lever 52.

Figure 14:
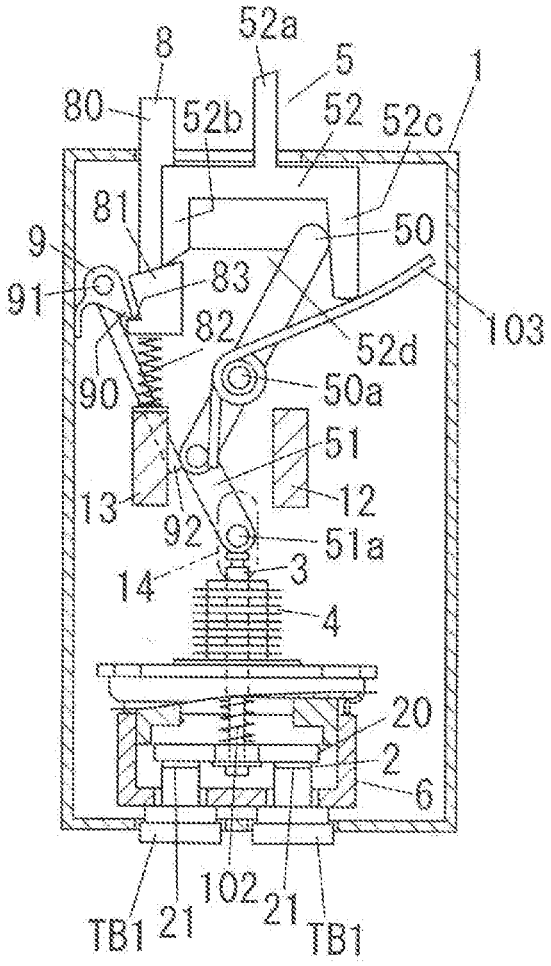
FIG. 14 presents another explanatory view for explaining an operation of the fifth embodiment.

FIG. 14 describes a state where the contact unit 2 is thermally bonded by, e.g., an over current. At this time, the over current protection function acts and, thus, the inner lever including the lever 50 and the link 51 moves in the open direction. Since, however, the contact unit 2 is thermally bonded, the connecting portion between the lever 50 and the link 51 does not reach the position to press the latch releasing portion 92. As a result, the latch of the locking body 8 is not released, and the locking body 8 is maintained in the release position. At this time, the outer lever 52 moves to the open position (OFF position) while being pressed by the inner lever. Therefore, whether the contact unit 2 is in a normal open state or is thermally bonded cannot be determined only by checking the position of the outer lever 52. The state of the contact unit 2 can be recognized by checking the position of the push button 80 of the locking body 8 as well as the position of the outer lever 52. In other words, when the outer lever 52 is in the open state and the push button 80 is in the release position, it is determined that the contact unit 2 has been thermally bonded.

In accordance with this embodiment, the recess 52*d* is formed at the outer lever 52. Thus, when the outer lever 52 moves in a state where the locking body 8 is in the release position, the outer lever 52 does not contact with the movement restricting portion 81. Accordingly, the outer lever 52 can be reliably restored to the original ON position (shown in FIG. 13C) by the elastic force applied from the biasing spring 103). Further, the elastic force applied from the biasing spring 103 to the outer lever 52 may be small, so that the convenience of the breaker can be enhanced without degrading the manipulability. In addition, the movement of the outer lever 52 is not stopped halfway and, hence, whether the contact unit 2 is the ON state (closed state) or the OFF state (open state) can be easily recognized.

Figure 16:
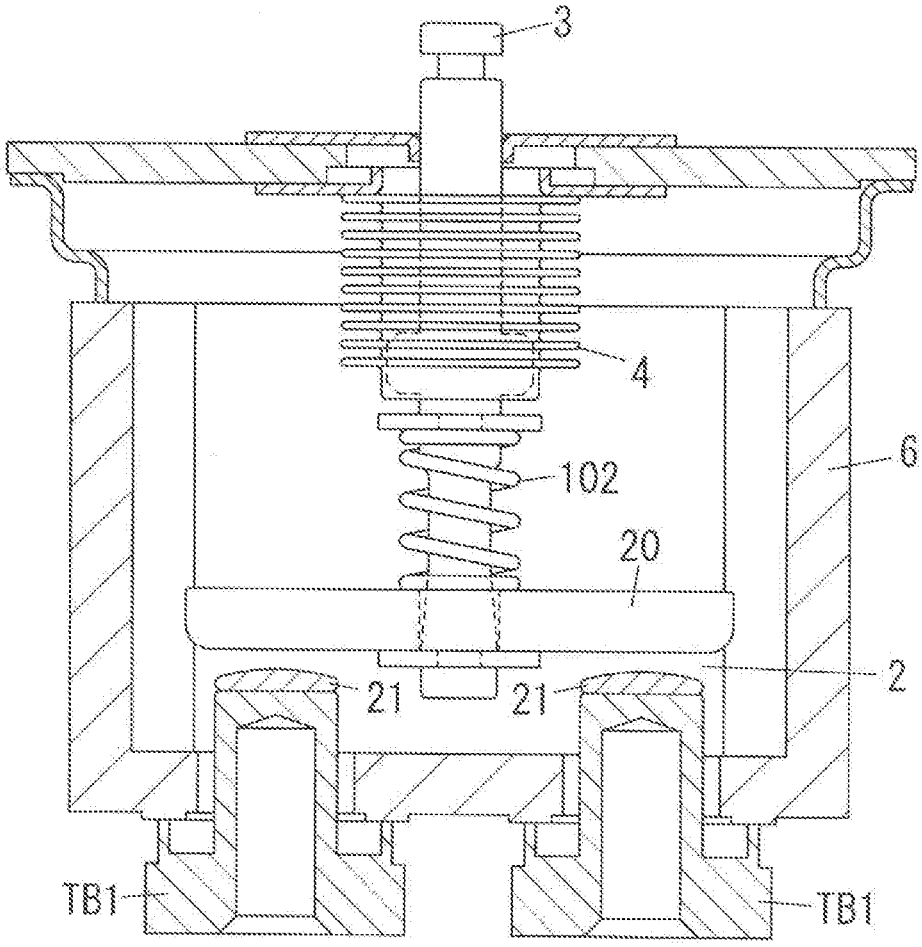
FIG. 16 is a schematic view showing another configuration of the contact unit in the breaker of the present invention.

In the above-described embodiments, the metal bellows which is extensible and contractible along with the movement of the movable shaft 3 is provided outside the airtight container 6. However, the metal bellows 4 may be provided inside the airtight container 6 as shown in FIG. 16, for example. In that case as well, the movable shaft 3 can move vertically while ensuring airtightness of the airtight container 6. As a result, the contact reliability of the contact unit 2 (the movable contact point 20 and the fixed contact points 21) can be improved. Besides, in this case, the height of the base 1 can be reduced compared to the case where the metal bellows 4 is provided outside the airtight container 6, which results in scaling down of the breaker. The configurations of the other components except the metal bellows 4 are the same as those of the first to the sixth embodiment, and redundant description thereof will be omitted.

While the invention has been shown and described with respect to the embodiments, it will be understood by those skilled in the art that various changes and modification may be made without departing from the scope of the invention as defined in the following claims.

What is claimed is:

1. A breaker comprising:

a contact unit provided in an airtight container, the contact unit having fixed contact points and a movable contact point which selectively contacts with the fixed contact points;

a movable shaft having a part projecting outward from the airtight container, for moving the movable contact point to and from the fixed contact points;

a metal member having one end fixed to the airtight container and the other end fixed to the movable shaft and being extensible and contractible in accordance with a movement of the movable shaft;

a lever unit configured to move the movable shaft between a closed position where the movable contact point is in contact with the fixed contact points and an open position where the movable contact point is separated from the fixed contact points, and a base accommodating therein at least the contact unit, the movable shaft and the metal member, wherein the lever unit includes: an inner lever disposed in the base and connected to the movable shaft; a manipulation portion projecting outward from the base; and an outer lever having a pressing portion for pressing the inner lever in accordance with the manipulation of the manipulation portion, the pressing portion of the outer lever and the inner lever being not connected to each other.

2. The breaker of claim 1, wherein when the inner lever moves from a position where the contact unit is in a closed state and passes beyond a predetermined position, a biasing unit biases the inner lever to a position where the contact unit reaches an open state, and a space where the inner lever moves is formed between the outer lever and the inner lever.

3. The breaker of claim 1, further comprising: a restricting unit which moves in accordance with a locking operation between a restriction position where the restricting unit is contacted with the pressing portion of the outer lever to restrict a movement of the outer lever and a release position where the restricting unit is separated from the outer lever to release a restriction of the movement of the outer lever; a first biasing spring for applying elastic force for moving the restricting unit toward the restriction position; a latch unit for maintaining the restricting unit in the release position; and a second biasing spring for applying elastic force of a predetermined direction to the outer lever, wherein a recess is formed at the outer lever so as to provide a gap between the outer lever and the restricting unit when the restricting unit is in the release position.

4. The breaker of claim 1, further comprising: a restricting unit which moves in accordance with a locking operation between a restriction position where the restricting unit is contacted with the pressing unit of the outer lever to restrict a movement of the outer lever and a release position where the restricting unit is separated from the outer lever to release a restriction of the movement of the outer lever.

5. The breaker of claim 4, further comprising a latch unit for maintaining the restricting unit in the release position, wherein the lever unit has a releasing portion for releasing a latch of the latch unit.

6. The breaker of claim 1, further comprising a display unit for displaying the state of the contact unit in accordance with a manipulation of the lever unit.

7. The breaker of claim 1, further comprising a biasing spring for pressing the outer lever to the inner lever.

8. The breaker of claim 1, further comprising an auxiliary contact unit whose contact points are opened and closed in accordance with the movement of the movable shaft.

9. The breaker of claim 1, wherein a predetermined gas having a pressure higher than about 1 atm is sealed in the airtight container.

10. The breaker of claim 9, wherein the gas contains at least one of hydrogen, nitrogen and carbon dioxide.

11. The breaker of claim 1, further comprising a restoring spring for restoring the movable shaft to the open position.

12. The breaker of claim 1, wherein the fixed contact points and the movable contact point are made of copper or copper alloy.

* * * * *